United States Patent [19]

McGunnigle

[11] Patent Number: 4,613,247

[45] Date of Patent: Sep. 23, 1986

[54] MULTIPLE FORMAT KEYBOARD

[75] Inventor: Roger J. McGunnigle, New York, N.Y.

[73] Assignee: FWM Enterprises, Inc., Somers, N.Y.

[21] Appl. No.: 676,610

[22] Filed: Dec. 3, 1984

Related U.S. Application Data

[63] Continuation of Ser. No. 401,913, Jul. 26, 1982, abandoned.

[51] Int. Cl.[4] ..... B41J 5/10

[52] U.S. Cl. ..... 400/486; 400/493; 400/484; 400/489; 400/496

[58] Field of Search ..... 400/261, 493, 485, 486, 400/496, 484

[56] References Cited

U.S. PATENT DOCUMENTS

| | | | |
|---|---|---|---|
| 1,013,084 | 12/1911 | Westin | 400/261.2 |
| 1,537,147 | 5/1925 | Smith | 400/261 |
| 1,610,911 | 12/1926 | Wilson | 400/261 |
| 1,713,607 | 5/1929 | Kidder | 400/261 |
| 1,736,125 | 11/1929 | Michelsen | 400/261 |
| 1,802,500 | 4/1931 | Des Jardins | 400/255 |
| 2,471,588 | 5/1949 | Sears | 400/261 |
| 2,697,503 | 12/1954 | Yaeger | 400/261 |
| 3,847,263 | 11/1974 | X | 400/486 |
| 3,934,247 | 1/1976 | Mueller | 400/493 |
| 3,944,043 | 3/1976 | Gremillet | 400/255 |
| 4,244,659 | 1/1981 | Matt | 400/486 |
| 4,280,121 | 7/1981 | Crask | 340/365 VL |
| 4,336,530 | 6/1982 | Loike et al. | 400/493 |
| 4,480,432 | 11/1984 | Willcox | 400/490 |

FOREIGN PATENT DOCUMENTS

| | | | |
|---|---|---|---|
| 616726 | 7/1935 | Fed. Rep. of Germany | 400/261 |
| 1080126 | 10/1960 | Fed. Rep. of Germany | 400/490 |
| 1932271 | 7/1977 | Fed. Rep. of Germany | 400/261 |
| 71133 | 6/1981 | Japan | 340/365 R |

OTHER PUBLICATIONS

Eliezer et al. "Key Identification System" IBM Technical Disclosure Bulletin vol. 19, No. 5, pp. 1548–1549, 10/76.

Bigbie et al "Programmable Key . . . Device" IBM Technical Disclosure Bulletin vol. 21, No. 2, pp. 442–444, 7/78.

Chukran, "Dual Keyboard . . . " IBM Technical Disclosure Bulletin vol. 26, No. 3B, p. 1425, 8/83.

Cooper et al., "Changeable Array Keyboard" IBM Technical Disclosure Bulletin vol. 11, No. 5, p. 524, 10/68.

Mathews, "Dual-Keyboard Graphics" IBM Technical Disclosure Bulletin vol. 19, No. 2, p. 375, 7/76.

Potak, "Quick Changeable Keytop Indicia" IBM Technical Disclosure Bulletin vol. 12, No. 4, p. 622, 9/69.

D. Larsen, "QWERTY Just Not Your Type?", Los Angeles Times.

"QWERTY Keyboard: a Historical Lesson", The Boston Globe, Jan. 6, 1985.

P. Niesink, "DSK Keyboard for the Apple," *Creative Computing* (1/82).

B. Seawell, "Alternative to 'QWERTY'," *Components* (11/83).

U.S. Navy Report, "Simplified Keyboard Retraining" (7/44, 10/44).

U.S. Navy Suggestion, "Improving Stenographic Production" (5/46).

A. Dvorak, "Pertinent Information Re Simplified Keyboard" (1/44).

A. Dvorak, "Better Typewriter Keyboard," Nat'l Bus. Ed. Qt. (12/43).

*Primary Examiner*—William Pieprz

*Attorney, Agent, or Firm*—Leo Zucker

[57] ABSTRACT

A keyboard arrangement suitable for use in typewriters, word processors, computer terminals and the like includes a number of manually actuable key members supported in a given array. Different letter formats can be selected for those key members corresponding to letter characters, wherein each of the letter character key members is made to correspond to a selected one of at least two different letters. Accordingly, a user can select, for example, either the conventional typewriter letter format or a new format wherein letters are assigned to the key members according to the frequency of use of the letters in a given language and the relative ease of accessibility of each key member to the fingers of the user's hands. In one embodiment, the key members in the left-hand portion of the keyboard array are arranged in columns which slope downwardly toward the left side of the array, and the key members in the right hand portion of the array form columns which slope downwardly toward the right side of the array.

18 Claims, 26 Drawing Figures

THE PRIMARY OF "PERFECT" FORMAT

A TYPEWRITER CALCULATOR KEYBOARD, ONE OF A MULTI-FORMAT DISPLAY. (DERIVED FROM USE OF LIGHTED DISPLAY ELEMENTS LETTER AND NUMBER INDICATORS)

THE UNIVERSAL FINGER-PRIORITY NUMBERED FORMAT OF ALL LANGUAGES

THE PRIMARY OF "PERFECT" FORMAT

E T A O N R I S H D L F C M U G Y P W B , V · K X J Q Z ; ?
1 2 3 4 5 6 7 8 9 10 11 12 13 14 15 16 17 18 19 20 21 22 23 24 25 26 27 28 29 30

THE FREQUENCY ALPHABET OF THE ENGLISH LANGUAGE

THE INTERMEDIATE FORMAT

THE FINAL AND IDEAL KEYBOARD LETTER FORMAT OF THE ENGLISH LANGUAGE FOR THE TYPEWRITER, THE COMPUTER AND THE WORD PROCESSOR

| % USE LEFT HAND | | | | | | | | | | | % USE RIGHT HAND | ROW TOTAL |
|---|---|---|---|---|---|---|---|---|---|---|---|---|
| 32.0 | Q 1.2 | W 15.4 | E 131.0 | R 68.3 | T 104.7 | Y 19.8 | U 24.6 | I 63.4 | O 80.0 | P 19.8 | 20.8 | 52.8 |
| 22.9 | A 81.5 | S 61.0 | D 37.8 | F 29.2 | G 19.9 | H 52.6 | J 1.3 | K 4.2 | L 33.9 | ;: 0.5 | 9.2 | 32.2 |
| 5.4 | Z 0.7 | X 1.6 | C 27.6 | V 9.2 | B 14.4 | N 71.0 | M 25.3 | ,; 10.0 | .: 6.0 | /? 0.3 | 11.2 | 16.6 |
| 60.4 | | | | | | | | | | | 41.2 | 101.6 |

FIG. 17

LETTER USE PER THOUSAND, WITH ROW PERCENTAGE USE, OF THE STANDARD FORMAT

| | | | | | | | | | | | | |
|---|---|---|---|---|---|---|---|---|---|---|---|---|
| 9.0 | Q 1.2 | W 15.4 | Y 19.8 | F 33.9 | P 19.8 | B 14.4 | L 29.2 | U 24.6 | V 9.2 | Z 0.7 | 7.8 | 16.8 |
| 36.5 | D 37.8 | O 80.0 | A 81.5 | T 104.7 | S 61.0 | R 68.3 | H 52.6 | E 131.0 | I 63.4 | N 71.0 | 38.6 | 75.1 |
| 5.3 | J 1.3 | X 1.6 | K 4.2 | C 27.6 | G 19.9 | M 25.3 | ,; 10.0 | .: 6.0 | ;: 0.5 | /? 0.3 | 4.3 | 9.7 |
| 50.8 | | | | | | | | | | | 50.7 | 101.6 |

FIG. 18

LETTER USE PER THOUSAND, WITH ROW PERCENTAGE USE, OF THE SCIENTIFIC FORMAT

| | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|
| E | N | A | R | S | I | T | U | O | L | D | C | P | M | V | F | B | G | Q | , | X | · | H | Y | Z | J | K | W | ; | ? | | |
| 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | | |

*THE FREQUENCY ALPHABET OF THE FRENCH LANGUAGE*

*THE PRIMARY OR "PERFECT" FORMAT OF THE FRENCH LANGUAGE*

EFFICIENCY PERCENTAGES OF THE FRENCH FORMAT

| BOTH | LEFT HAND | | | | | | | | | | | RIGHT HAND |
|---|---|---|---|---|---|---|---|---|---|---|---|---|
| 15.8% | 5.7% | W 0.1 | H 0.5 | Y 0.4 | C 3.9 | G 0.8 | B 0.9 | V 1.9 | U 6.6 | X 0.5 | Z 0.2 | 10.1% |
| 75.7% | 34.3% | L 5.7 | I 6.7 | O 6.6 | N 8.6 | S 6.7 | D 4.7 | R 6.8 | E 16.2 | A 7.1 | T 6.6 | 41.4% |
| 9.8% | 4.7% | ; 0.1 | J 0.2 | K 0.1 | P 2.9 | F 1.4 | Q 0.7 | M 3.2 | , 0.6 | . 0.5 | /? 0.1 | 5.1% |
| TOTALS 101.3% | 44.7% | | | | | | | | | | | TOTAL 56.6% |

FIG.21

THE INTERMEDIATE FORMAT OF THE FRENCH LANGUAGE

| | | | | | | | | | | | | |
|---|---|---|---|---|---|---|---|---|---|---|---|---|
| | W 28 0 | H 23 0 | Y 24 +4 | C 12 0 | G 18 0 | B 17 0 | V 15 +4 | U 8 -11 | X 21 0 | Z 25 +2 | | |
| 0=6 +10 -11 | 28 | 22 | 20 | 12 | 18 | 17 | 11 | 19 | 21 | 27 | | |
| | L 10 +2 | I 6 0 | O 9 +5 | N 2 0 | S 5 -5 | D 11 +2 | R 4 +3 | E 1 -2 | A 3 -2 | T 7 0 | | |
| 0=3 +12 -9 | 8 | 6 | 4 | 2 | 10 | 9 | 1 | 3 | 5 | 7 | | |
| | ; 29 0 | J 26 0 | K 27 +3 | P 13 0 | F 16 0 | Q 19 +4 | M 14 0 | , 20 -3 | . 22 -3 | /? 30 0 | | |
| 0=6 +7 -6 | 30 | 26 | 24 | 14 | 16 | 15 | 13 | 23 | 25 | 29 | | |
| 0=15 +29 -26 TOTALS | | | | | | | | | | | | |

FIG.22

THE INTERMEDIATE FORMAT OF THE FRENCH LANGUAGE COMPARED TO THE UNIVERSAL FINGER PRIORITY-NUMBERED FORMAT

THE PEOPLE'S FORMAT

STANDARD FORMAT DIMENSIONS

SCIENTIFIC FORMAT DIMENSIONS

| | LEFT HAND | | | | | | RIGHT HAND | | | | | |
|---|---|---|---|---|---|---|---|---|---|---|---|---|
| ROW | 4th FNGR. | 3rd FNGR. | 2nd FNGR. | INDEX FNGR. → | INDEX | ℄ | INDEX FNGR. ← | INDEX FNGR. | 2nd FNGR. | 3rd FNGR. | 4th FNGR. | MOVE No: |
| MID | | | | #2 | | | | #1 | | | | 1 |
| MID | | | #4 | | | | | | #3 | | | 2 |
| MID | | #6 | | | | | | | | #5 | | 3 |
| MID | #8 | | | | | | | | | | #7 | 4 |
| MID | | | | | #10 | | #9 | | | | | 5 |
| TOP | | | | #12 | | | | #11 | | | | 6 |
| BOT | | | | #14 | | | | #13 | | | | 7 |
| BOT | | | | | #16 | | #15 | | | | | 8 |
| TOP | | | | | #18 | | #17 | | | | | 9 |
| TOP | | | #20 | | | | | | #19 | | | 10 |
| TOP | | #22 | | | | | | | | #21 | | 11 |
| BOT | | | #24 | | | | | | #23 | | | 12 |
| BOT | | #26 | | | | | | | | #25 | | 13 |
| TOP | #28 | | | | | | | | | | #27 | 14 |
| BOT | #30 | | | | | | | | | | #29 | 15 |

FIG. 25

MULTIPLE FORMAT KEYBOARD

This application is a continuation of application Ser. No. 401,913, filed July 26, 1982, and now abandoned.

BACKGROUND OF THE INVENTION

1. Field of the Invention

The present invention relates to keyboards and more particularly to a keyboard having selectable letter formats for minimizing operator fatigue and increasing speed. The invention also relates to a process for arriving at an optimum keyboard letter format for any given language.

2. Description of the Prior Art

The present-day typewriter has evolved from the nineteenth century into instruments which can be operated manually or electrically, as well as becoming part of the modern computer terminal in the form of a keyboard. With the computer keyboards, information which is entered may be printed at once or at a later time. Operating any one of these instruments today with the standard QWERTY format for the characters on the keyboard, however, disregards the natural use of the operator's hands, particularly the left hand. Thus, only the trained professional typist, having become used to the conforming demands of the QWERTY format, can use any of these instruments with proficiency.

So it is that modern users of the QWERTY format are, for the most part, of two distinct classes. The professional typists, who may never purchase a keyboard instrument but can earn their living operating one, are the only ones recognized by most manufacturers who persist in providing only the QWERTY format. Entrepreneurs and others, who buy such instruments later in life and haven't enough time to learn the touch-type demands of QWERTY and who must "peck and hunt" at the keyboard, are generally unrecognized by those who manufacture it.

The need for a mass-produced keyboard instrument having formats other than QWERTY has been reflected, for example, in recent articles discussing the DVORAK simplified keyboard ("DSK") as one alternative. The DSK format is, however, directed only to the English language. As the world-wide sales of keyboard instruments with the QWERTY format continues, it is imperative that easier formats be made available for users in non-English speaking countries.

SUMMARY OF THE INVENTION

This invention proposes to redress the irrationalities in the modern typewriter instrument and its electronic take-off, the Computer, by bringing about solutions that will make these machines in the near future easier to learn; easier to operate and with less fatigue; increase the average speed and with less typing errors; principally, by adding a new language-adapted scientific format to them that will overcome all the above disadvantages. The proposed process in this invention of evolving a format is precise enough so that it can create a custom-tailored keyboard for every major language in the world, and eventually eliminate the standard QWERTY format that now blankets most languages, completely ignoring the idiosyncrasies of each.

Further, with the physical keyboard properly aligned to the left hand and with several other thoughtful improvements offered in this invention, it may well be that the burgeoning Computer, the world's fastest machine, may well have an optimum keyboard for enabling persons to communicate with it efficiently well into the distant future.

1. The Rational Multiple Format Writing Machines

A means to provide Multiple Formats. This Invention proposes a mechanism allowing typewriters to have a dual or multiple formats, that with the push of an added key will provide instant choice between the present standard QWERTY format and a language-adapted or user oriented one. It is significant that in this dual or multiple form, one and the same machine can be used by both generations of users; those who use the standard format and choose not to change, and those people who in the future will learn only a new efficient format. With this mechanical change on the Typewriter, corresponding changes in the Computer and the Word Processor can be implemented electronically, as well. Only then it can be said that the world's fastest machines also have the most efficient of keyboards to enable persons to communicate with them expeditiously.

Over the 108 years since the first commercial typewriter appeared, many attempts have been made to overcome the inefficiencies of the Standard Keyboard with a better designed one. None of them has ever been able to replace it, however, since there has always been resistance by many in accepting any other format.

Estimates abound that the number of computers will increase in the United States in the next ten years to perhaps nearly thirty million. Since the Computer and the Word Processor have adopted the typewriter QWERTY keyboard as their own, this vast proliferation of machines saddled with an awkward format will be an unnecessary burden unless a way is found and accepted to adopt a more scientific format in the next few short years.

A clear outline of the mechanical changes required for the present day typewriter machine to be converted to a multiple format arrangement will be found in the Mechanical Review, below.

Two format indicators are shown, for example, for an electric typewriter in FIGS. 1 and 3. A format mechanism, in each instance, coordinates the movement of the indicator to move in conjunction with the change of format, showing its name in a small window that appears on the keyboard.

The typewriter of FIG. 1 has a flexible steel tape 46 holding the lettering 46B of the format name, and it is pulled or pushed up or down by a power lever which is connected to the tape at 46A. The steel tape 46 is held and enclosed in a plastic sheath 46D and its format indicator lettering 46B is properly spaced in correspondence to the movement of lever 37, to set the lettering for a selected format in a format window 46C.

In FIG. 3, a generally T-shaped format indicator 56 is connected directly at the base of its leg to a shaft 36. Format indicating letters 56B are provided on the top surface of the "T", the spacing for the letters 56B being determined by the angle of arc and the radial length of the indicator 56 with respect to the shaft 36.

Many letter formats are possible for both the electric and manual typewriter machines. Uses may be found for having many formats on one machine (as in the Chinese language that has many ideographs). As shown in FIG. 1, multiple character type strike bars 12 can bring about a mechanical solution for providing two or more formats. A typewriter mechanism capable of providing for two formats, each with upper and lower case, is disclosed, for example, in U.S. Pat. No. 2,471,588 issued May 31, 1949. The relevant portions of U.S. Pat. No. 2,471,588 are incorporated herein by reference. Providing correspondence between a selected one of a number of letter formats and the keys on an electronic keyboard can be accomplished by, for example, providing additional wiring configurations for the keys per format, to make different formats selectable for the keys on a given keyboard.

A distinct need exists for a third type of format that will allow for such legibility that there be no need of special training to operate the machines. It is believed that over half of the keyboard users through the world (and perhaps over half that amount are independent buyers) do not use the touch system. It is clear by their (unrecognized) representation alone that a special keyboard should exist independently on the machine for their use that has been adapted for simple operation. Such an especially adapted keyboard is seen in FIG. 23. Here, all the most frequently used letters are clustered in the middle four columns of the keyboard for greatest visibility and digital accessibility.

Undoubtedly there will be a demand upon manufacturers of the machines to make other special formats to be used in this third area, lending further flexibility to the multiple form of machine.

Included in this heading but a separate item are FIGS. 24A&B showing the dimensions compared of the two Formats, the Standard Format and the Scientific Format. The new format preferably is 3/16" wider, a small amount, despite the left downward flow of the left-hand keys on the new keyboard's physical configuration.

MECHANICAL REVIEW

To manufacture a typewriter with three formats, that is, with two additional formats added to the existing standard or QWERTY format, the letter strike-heads on the lever bars and the shift mechanism must be altered. Added to the strike-heads of the standard format with a lower and upper case of a letter on each, would be two more sets of letters representing the two new formats, making the strike-head longer. To be able to match these new sets of letters to the platen at the writing line, the shift mechanism would have to be made more sophisticated to fulfill the dual demand of each new format, by that mechanism allowing for the mutual level required to create the new format, and again create a new level for the use of the upper case of the new usable format.

The typewriter industry has provided two ways for the machine to match the second row of letters, the upper case of the standard format to the platen. One, by raising the platen to meet the row of letters, with the type bar remaining unchanged; and, two, by lowering the letter basket for the upper case letters on the strike-head to meet the writing line on the platen, with the platen remaining unchanged.

This invention takes advantage of the mechanism of these small movements to make the upper case, to bring about a format change by use of a separate mechanism, controlled by appropriate lever keys, that double the length of these movements for the second format, and once again for the third format. However, the arrangement of the mechanism to reach the upper case is always the same one for each format, including the lock and release; all being the same in action control as on the standard format.

All other normal controls remain intact, such as the case shift keys being found on the right, for right-hand action, as well as being provided for the left by a joint shaft. The vertical guides for the vertical movement of the platen and the letter basket, holding them true, of course must be lengthened to accord with the greater movement. Stop guides for both rise and rest of the platen and the basket must be added for the new extra movements.

BRIEF DESCRIPTION OF THE DRAWING

In the drawing:

FIG. 17 is a plan view of a QWERTY keyboard with letter and hand use for the English language being represented numerically;

FIG. 18 is a plan view of a keyboard having the ideal or scientific format of FIG. 14 and with letter and hand use being represented as in FIG. 17;

FIG. 21 is a plan view of a keyboard on which the keys are lettered in an intermediate format of the French language, according to the invention;

FIG. 22 is a view of the keyboard of FIG. 21, wherein deviations of the key letters from the universal format of FIG. 9 are represented numerically;

FIG. 25 is a representation of a method of establishing a numbered priority for movements of fingers from a middle row of keys on a keyboard.

DETAILED DESCRIPTION OF THE INVENTION

Figure 1:
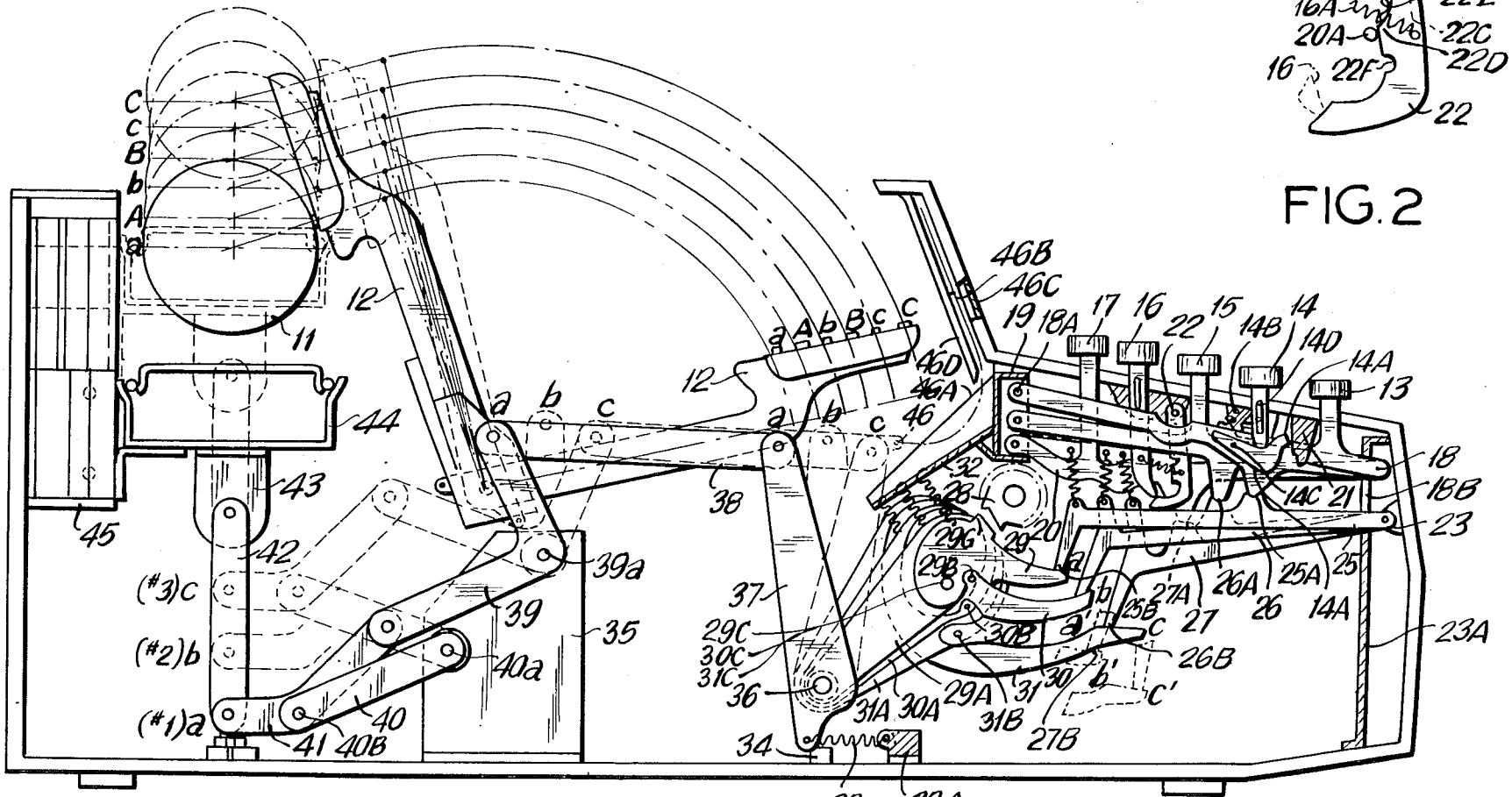
FIG. 1 is a side sectional view of an electric typewriter including a selectable format mechanism according to the invention.

FIG. 1 is a sectional side elevation of an electric typewriter with rising platen. The machine is powered by a typical kind of eight toothed revolving shaft 28 that fits the inside width of the chassis. The control key levers are five in number; two for shift to upper case, two for each format rise, and one for release from these positions. It is seen, as on the manual machine, even as on the standard typewriter, the mechanisms that cause movement to bring about the upper case is the same movement, but just more of it, to arrive at a new format.

The three levers that cause shifting are on a double hinged arrangement of two levers to enhance the action. Pressing on the forward key lever to make the upper case the shifting mechanism that is best viewed in the drawing in FIG. 4 for a clear understanding of what is involved. The extended key lever has but to touch the single toothed gear activator 29 which throws its tooth in the path of the revolving power gear, moving the whole rest of the mechanism connected to shaft 36 that brings about the 1 step rise of the platen for the upper case. Lock arrangement to this level is achieved on pressing the second key lever that swings the lock lever down to catch on the chassis. This is easily released from this position by the movement of the first lever which allows the lock lever to give up its catch on the chassis, allowing the entire mechanism to revert to the lower case, an action aided by the strong spring 33 and the gravity pull on the carriage and platen ensemble.

Figure 2:
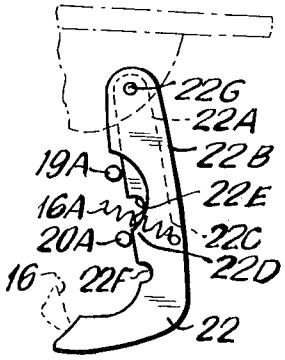
FIG. 2 is an enlarged view of a portion of the typewriter of FIG. 1.

Rise to another format happens on a push of the third key lever, moving its bars creates a similar action as described above for the upper case. However, the two toothed gear activator is put to work this time, creating greater movement on the shaft below because of the throw of the two teeth against the power shaft. This action locks the machine into the new format by the separate vertical swinging locking lever whose edge-face cuts catches the pin in the horizontal lever as it moves down. Release is easily attained from the format by pressing the fourth key lever bar, the toe of which touches the tail of the lock lever, releasing the lock pin from its hold. FIG. 2 is an enlarged view of the vertical lock lever in its relation to the locking pins and the release lever.

The third format is arrived at by pushing on the fifth key lever, bringing into action the four tooth activator that moves the connecting shaft in a double throw to bring about the required format.

The geometry of these moves starts in the initial one-tooth-gear-activator, whose tooth width is $\frac{1}{8}$th of the circumference of the revolving power shaft, which being a $\frac{1}{2}''$ in diameter makes this one tooth space, peripherally, as being 4.98 mm or 5 mm, causing a movement of 6.5 degrees to achieve upper case movement.

Shifting to other formats is designated in the drawings as the lower case of each, as "a", "b", "c", and their passing upper case as being "A", "B", "C". The three formats are represented in pairs, alternately, of these letters on the strike head, as "a", "A", for the first format, etc. The lower case letters represent the machine at its natural rest for a given format, as the machine is changed from one to the other. Again, in the same given order, they are sometimes called first, second, and third formats. In considering a format change it is assumed that the machine is in its lowest position, the "a" format, or first format.

Figure 3:
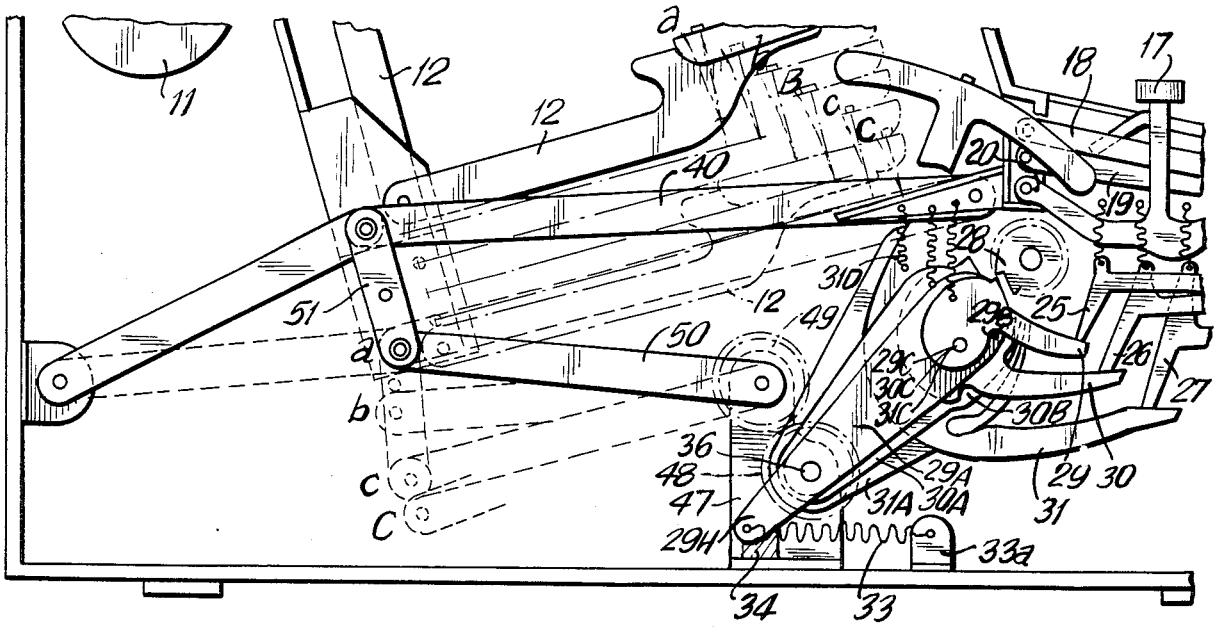
FIG. 3 is a side view of a multiple format electric typewriter with a dropping letter basket according to the invention.

FIG. 3 is a part side sectional elevation of a multiple format electric typewriter with dropping letter basket. The forward part of the machine need not be shown as it is identical the electric model of FIG. 1, which also includes the power shaft and the various gear-tooth activator levers, right down to the shaft 36 where they all connect. Beyond this point the transfer of the movement, being reversed from the rising platen model, indicates a small gear on that shaft coupled to another pulls down the platen on demand. This is clearly shown in FIG. 4 that shows the end action of both these models.

DESCRIPTION OF SHIFT MOVEMENTS

FIG. 1 is side sectional elevation of a multiple format electric typewriter with a rising platen. The machine is powered by an eight toothed shaft 28 extending across the chassis, shown revolving anticlockwise.

To set for the upper case, a front key lever 13 is pushed down, and as it is integral with a long horizontal lever 18, it swings from a fixed pin 18A on chassis mount 19 at the rear, and in a comb-slot 18B in front. Through two extended mutual contact points on each edge, lever 18 moves a contact lever 25 at point 25A and swings the lever 25 from a fixed pin 23 in the front of the machine. Contact lever 25 is given added leverage and movement by this arrangement. The nose end 25B of this lever 25 touches the extended arm of the one tooth gear-activator 29 at point a, moving it a small distance but enough for its tooth 29G to catch on a tooth of the revolving shaft 28, turning it on pin 29C that is based on the lever extension 29A. A stop pin 29B is also located on the extension 29A. It allows the slight movement for the activator 29 to move into the path of the power shaft 28, and after it does the activator 29 is prevented from swinging any further by the stop-pin 29B. This immediately transfers this action to the lever extension 29A which is connected to the mounted transfer shaft 36 by its holding collar 29D.

Figure 4:
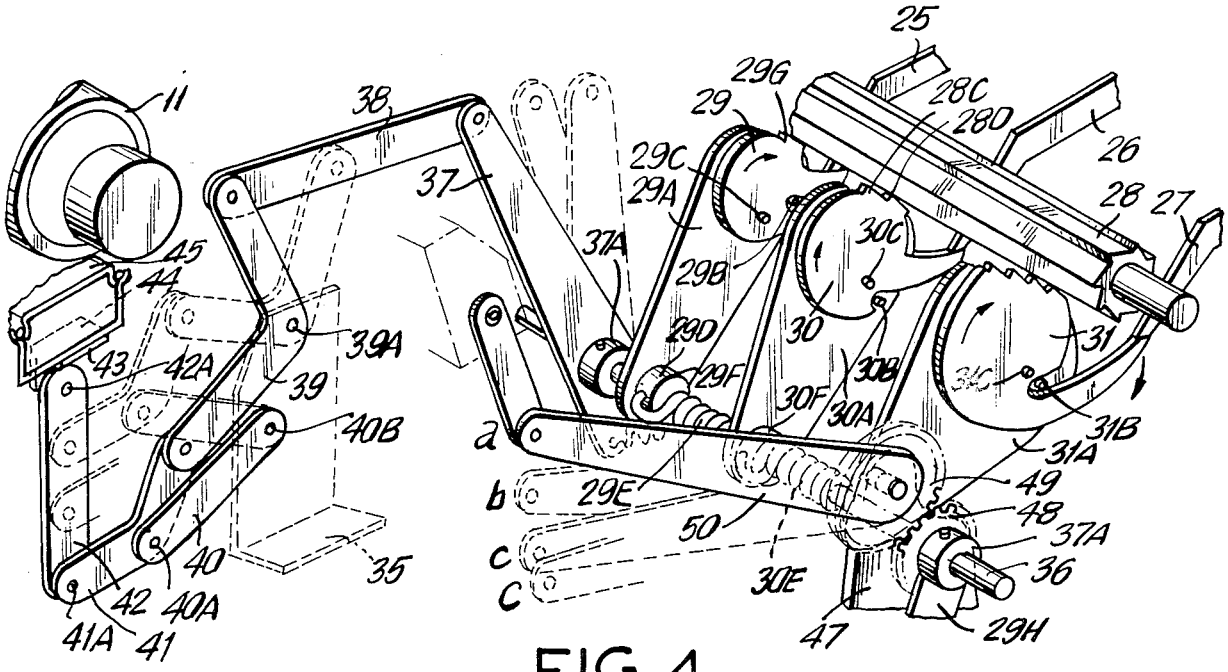
FIG. 4 is a perspective view of a mechanism for rising either a platen or a letter basket in the electric typewriter of FIG. 1.

This set-up is best seen in FIG. 4, where the three double activator levers 29A, 30A and 31A are set up on the transfer shaft 36. In order for these three levers to transfer movement independently of one another, they all have been provided with spring clutches 29E, 30E, and 31E; each being activated by the activator 29, 30 or 31 to which it is attached, and not by the shaft 36 or from other pulse sources. Movement of any one of the levers 29A, 30A, 31A causes its spring clutch to squeeze the periphery of shaft 36 and momentary movement of the corresponding lever the required distance to cause shifting to an upper case.

The single tooth 29G of the activator 29 is moved by ⅛ the circumference, or one tooth spacing of the power shaft 28. As indicated, this movement moves down through the two levers 29 and 29A, the collar 29D, and the spring clutch 29E to the shaft 36, to the power lever 37, directly through its connecting collar 37A. This lever 37 is the same length as the activator 29 and lever 29A combined, so that it has the same movement of arc. The pulse then continues through the median lever 38 through three paralleling levers 39, 40 and 41 and their respective connecting pins. The first of these levers 39 is a bell crank that is fixed to a chassis flange 35 on pin 39A. The second is a bent lift lever 41 and it is connected to the bell crank 39 at one end and to a vertical rise lever 42 at the other end. The third is a paralleling lever 40 which connects at one end to the bent point of lift lever 41 with pin 40A, and to the flange 35 at the other end with pin 40B.

This arrangement allows lever 41 to give smooth rise to the vertical lever 41, through pin 41A, and an angle clip 43 through which pin 42A is attached to a slide rise control 45. The latter holds the platen 11. The foregoing arrangement provides a one step rise to put the machine into upper case use momentarily, and in any of the selected formats.

As in standard practice, if the upper case is used for the moment, releasing finger pressure on key lever 13 allows the whole mechanism to drop back down again to lower case, as gravity and the strong spring 33 will return all parts to rest position.

Though letter basket action, as shown in FIG. 3, is on an angle, the 5 mm step to reach upper case and the 10 mm double step it moves to change formats are true distances that match to the letter-spread on the strike heads; as basket and lever keys are all of one unit. But this is not so on the rising platen because of the peculiar triangulations the type bar must go through in matching the writing line as the platen rises. As best can be determined, to meet the total spread of the six letters on the strike head of 25 mm total, the platen must rise 29 mm to match it. An 11.6 mm rise is needed to change to a second from a first format; and for three formats the rise is 23.2 mm, leaving 5.8 to total the 29 mm rise to get to the upper case.

To use the upper case continuously, pressing on key-lever-lock 14 puts to work all the mechanism described above, and it locks any of the upper case positions into continuous use. Though lever 14 is a completely separate key, note that the double pin and slot arrangement 14D, allows it to slide and push with its toe on the locking lever 14A, against the resistance of its spring 14B, and pivoting on pin 14C, and so pressing down, fits against the notched fixture 21, to lock the entire mechanism into any of the upper-case in whichever format is chosen.

Meanwhile, the small bulge on the left side of the key lever 14 is also bent at a right angle so that it may reach and touch the top of long lever 18, moving it down and allowing it to duplicate the action of key lever 13, described above, locking the whole mechanism into the upper case of a selected format.

To release from the upper case lock, a light touch on key lever 13, moves the long lever 18 with which it is integral down, releasing the engaged part of locking lever 14A, allowing it to clear the notch it was caught in, and its spring 14B pulls it back and away, dropping the whole mechanism down and returning it to the lower case in whichever format is selected.

Changing to another format is started by pressing key lever 15. Much of what happens is similar to the action of moving to the upper case. Long lever 19 moves down and its contact point meets a corresponding one on contact lever 26 as it swings on an extruded pin 23 in the front part of the chassis. Its nose end 26B at point b of lever 26 moves the extended arm of geared-tooth-activator 30, forcing it to revolve off center and throwing its first tooth 28C, and then its second tooth 28D into the gear teeth of the power shaft 28, which moves lever 26 10 mm. The rest of the action is as immediately described above to use the upper case, except that the 10 mm movement throws the machine into a different format move instead.

Locking into format takes place automatically on the downward movement of long levers 19 or 20, when moved by a push of respective key levers 15 and 17. The lock lever 22 hangs vertically on a chassis pin 22G (FIG. 2), allowing it to swing slightly with the movement of its attached spring 16A forcing it against pins 19A and 20A on levers 19 and 20. As lever 19 is pressed down to get to format b, its pin 19A fits to the slot 22E in the left face of the lock lever 22, holding the entire mechanism in the selected format.

Release from a second selected format is done by pressing key lever 16, the toe of which presses against the tail of the lock lever 22, letting pin 19A free from the holding slot 22E in the lever. Release from a third format which can be selectively locked by the dropping action of long lever 20 on being pressed by key lever 17 and letting its pin 20A fit to slot 22F on the edge of the lock lever 22, is accomplished similarly, as described above. The locking action, of course, comes about by going into the third format, with the only other difference in parts being, principally, the four tooth activator 31 throwing the rest of the mechanism a 20 mm distance, and doubley to move to that higher format.

FIG. 3 is a part side sectional elevation of a multiple format electric typewriter with dropping letter basket. All its forward controls and actions are identical to those in FIG. 1, and including the throw mechanism up to the connecting shaft 36. As the action must reverse for the letter basket to drop, two matching gears reverse this action, where gear 48 is attached to the shaft 36, and another gear 49 is connected to a shaft 49A on fixture 47 that is attached to the chassis. Here a single connecting lever 50 is connected to a short lever 51 that is attached directly to the letter basekt, bringing it up or down in controlled movement to all lever control demands.

II. A USEFUL KEYBOARD FOR THE TYPEWRITER AND THE COMPUTER

The constant slope of columns or keys on the standard keyboard has worked well for the natural lay of the right hand but disregards this aspect for the left hand, allowing for stress and fatigue in the touch system, which, from the standard letter layout, also demands more use of that hand than the right.

In mechanical and electric typewriters alike, the spacing of the descending key lever bars was not set up as 1,2,3,4 corresponding to the four rows, for the pattern is instead, 4,1,2,3. This order sets up a zig-zag effect of the letters down any given column of keys, lending for more confusion.

Figure 5:
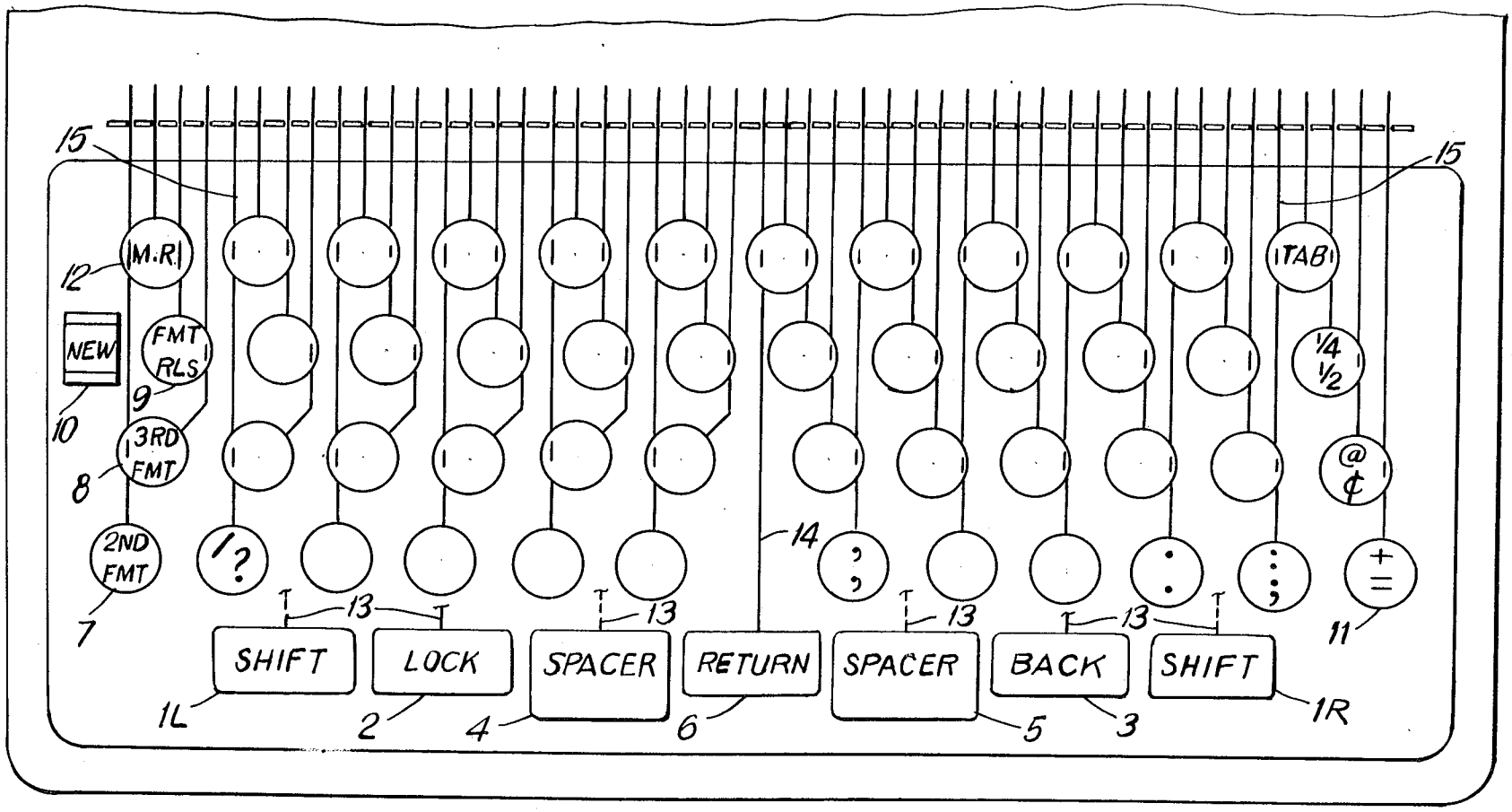
FIG. 5 is a plan view of a keyboard configuration according to the invention.

FIG. 5 shows a keyboard with keys having key levers, and a leftward and downward diagonal slope of the left-hand keys from row to row, conforming to the natural use of the left hand and fingers. This leaves a parting space between the left and right halves of the keyboard, which has a clear function in itself; there is no mistaking, either visually or digitally, what letters are on which side of the center line of the keyboard; that space acts as a true center line, per se. One of the great points of confusion for the learner and non-learner on the standard keyboard arrangement is the lack of any defined separation of the activities of the two hands.

As seen in FIG. 5, where the two sets of sloping keys are symmetrical in their slope away from each other, this allows the lever bars to be properly arranged in 1,2,3,4, order, even though the key columns of each hand slope in opposite directions, and the letters of any vertical row or column follow down in a straight line (except for the first five numbers at the left side top row). However, the spacing for this order is different for the left hand but is made up by bending the first five letters in the middle row of the left hand on an upward diagonal, properly filling this space to maintain the correct order.

Maintaining the standard keyboard in its physical layout at first seemed necessary, but in arriving at the present equi-angular sloped keyboard it was realized that its superior physical layout provides a more efficient way of using the fingers properly, and thus should be available to all users. The few upsetting days a manual tupist has changing over to an electric model, is comparable here towards a person getting used to the layout of FIG. 5, with nearly as many advantages.

Figure 24A:
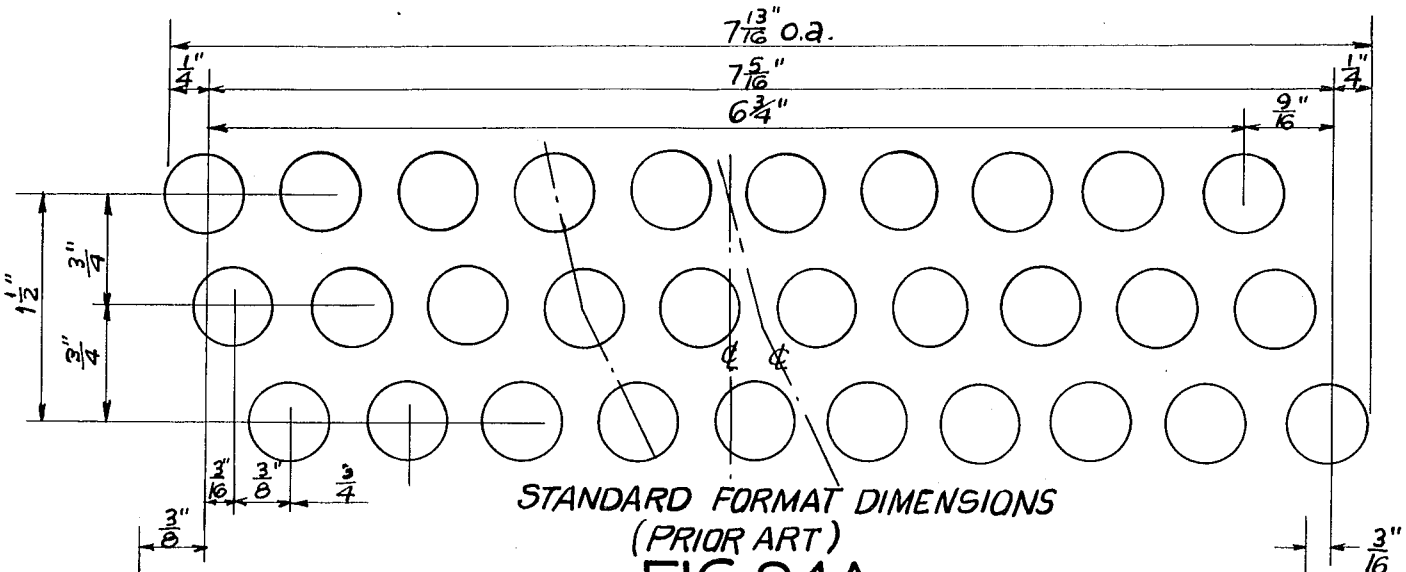
(PRIOR ART) FIG. 24A
FIG. 24A is a plan view of a conventional keyboard configuration.
Figure 24B:
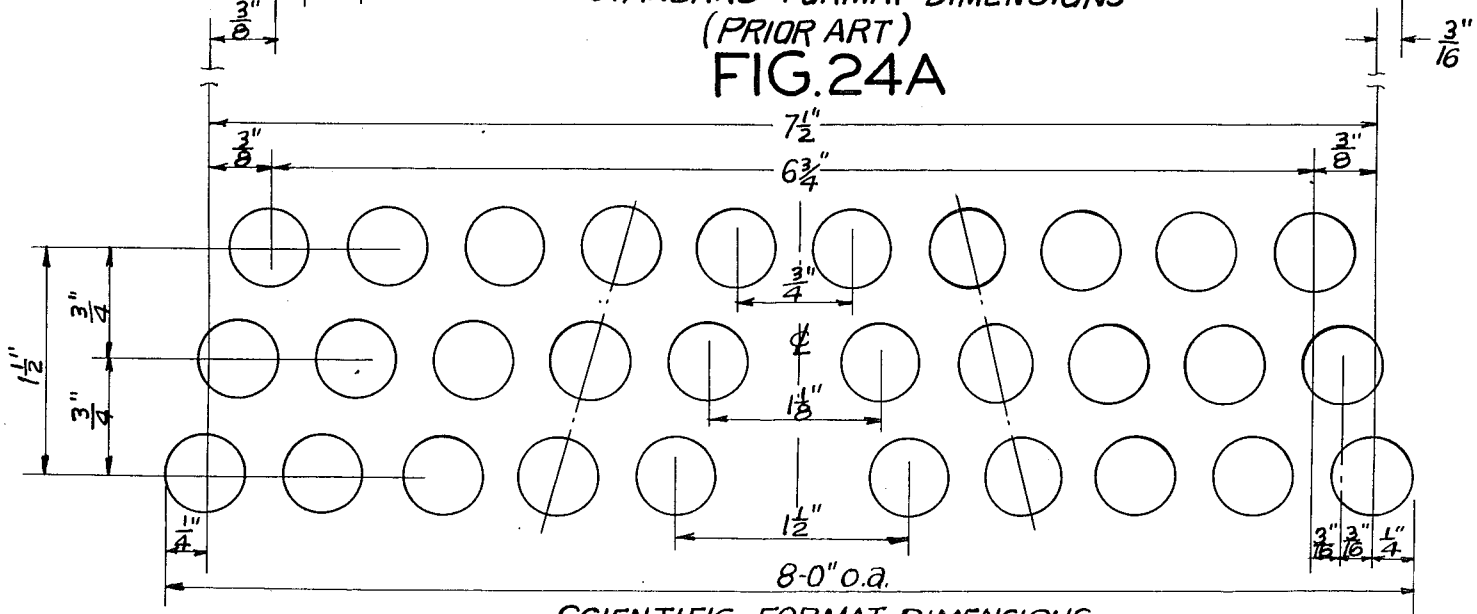
FIG. 24B is a plan view of a keyboard configuration dimensioned according to the present invention.

FIGS. 24A and 24B show comparable dimensions for the present preferred keyboard arrangement (FIG. 24B) and the conventional one (FIG. 24A).

The small area that the two thumbs occupy while hovering over the space bar is all that need be taken up by the bar. The rest of the long space can well be used for other key controls.

As seen in FIG. 5, the area conventionally occupied by the space bar has been cut up into seven one inch segments. Two outer bars, left and right 1L and 1R displace the regular upper case shift keys from their side positions, a move of one inch in and one inch down. This is slight enough that the fourth or little finger that ordinarily controls them, can continue to do so with a minimum change in habits.

The next bar in on the left is a case-shift lock-key 2 removed from its usual position on the left of the machine and is controlled by the second or third finger.

The next bar in on the right is a back spacer 3 removed from its previously ambiguous place on the machine to this accessible area, and is controlled by the second or third finger.

The next two inner bars, left and right, 4 & 5 are all that need be left of the spacer bar, quite wide enough for the hovering thumbs.

The center bar is the natural place for a carriage return key 6, ably operated by either thumb.

Note that the true placement of two new format shift keys 7 and 8, along with their release key 9, and a format indicator window 10 are designated for the areas shown in FIG. 5, displacing nicely the case shift keys moved away from the left of the machine. The case shift and release key now on the right can be replaced with a (+) and (=) key 11. The M.R. key 12 can remain in the upper left area, found there on most machines.

The six lever bars of the control keys 1L and 1R,2,3,4,5 all return under the letter key levers, as do the two lever bars of the long spacer on the standard machine, to their individual points of control in the back. The return lever bar 14 fits into one associated empty comb-slot on the centerline of the new keyboard arrangement, similar to all the rest of the letter key lever bars. Similarly, this is also true for all lever bars 15 where comb-slot space is regularly allowed for keys at the ends of the keyboard.

The second major concern of this invention recognizes that about half of all the people that type do not use the touch system, and their needs must be considered, be it business machine or portable. It is recommended then that all control keys, as distinguished from letters or numbers, be color coded, to not only easily note their difference but also to set-off the number-letter keyboard, itself.

It is also noted that since changing to another format will likely be only an occasional practice and not of momentary demand as on other control keys, the new format shift keys 7,8,&9 can be made slightly stiff in operation, to frustrate their inadvertent use.

Figure 6:
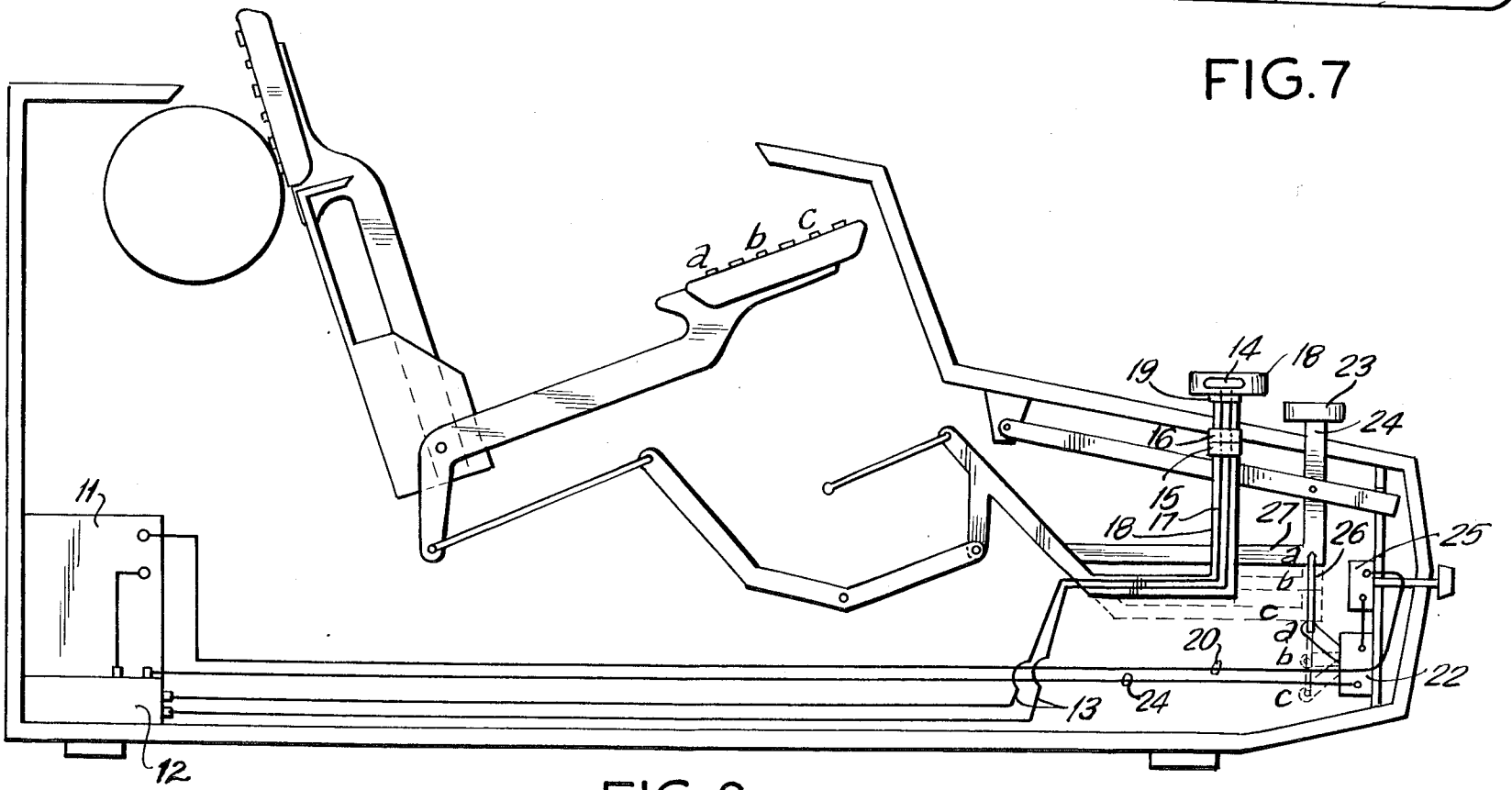
FIG. 6 is a side sectional view of parts of a typewriter including circuitry by which the letters of a selected format appear on corresponding key tops, according to the invention.

The following describes a way of changing all the letters represented on the keyboard instantly when selecting another format. FIG. 6 shows a system for applying low local power fed to a typical I.C. circuit that actuates L.E.D. pixie tubes. These tubes may be of a three-letter configuration put in the surface of all keys with letter functions. A switch is connected to the bottom of the format key levers which would have a built in potentiometer for changing a voltage signaling each format, to which the I.C. circuit is made sensitive. A set of letters on the keyboard of the required format is then indicated on the keys. A separate potentiometer can act as a shut-off switch and light dimmer for the professional who would not need the system or for those who would not need to see the letters so brightly.

The many who struggle with using the conventional keyboards would find such an individual way of picking letters, a joy. Many who are buying computers today do not know how to touch type. For the professional learner, the brilliantly lit keyboard would help burn the key order into memory much more quickly. For the typewriter industry, advertising and window display of the machines shown lit up, and even having the machines mechanically change formats every several seconds, would awaken a new public interest in them. The same would be true of keyboards for computer and data processing in public display.

In further detail, a power source 11, whether a battery or a step-down transformer from 117 volts, is connected on one side to an I.C. 12 of a kind used in a calculator to control pixie or other display elements 14. The display elements 14 are each of a three letter configuration, each corresponding to a different format as selected from the keyboard.

A wire 20 from the power source 11 is brought forward on the floor of the machine where it is connected to a switch and potentiometer 25 which in turn connects to a three tap potentiometer 22 that has no knob control. Instead, the pot 22 has a swinging arm in the back that is connected to the bottom of a key lever 24 of format changer key 23. A metal link 26 connects to the swinging arm and moves up and down with the one key format selecting key-lever 24 shown in FIG. 6. Each format change causes a change in voltage in the pot 22 which provides a corresponding voltage through return wire 24 going to the I.C. 12.

Coming out of the I.C. 12 are two sets of multiple fine wire cables 13 that run along the floor of the machine and are tied to all lever bars 27 of the letter keys, and they end in a small multiplug 15 before the key which plugs into a mating connector 16. Short wires from connector 16 connect directly to the display elements 14 in the proper order so as to create a selected one of three letters, to make for a change of format for all the letter keys 18.

The present multiple format typewriter can be a dual or triple language machine where formats markedly differ, as with English and Russian. A process for making precise scientific or language-adapted formats for the major languages is described later below. With such process, new differing formats of any two other countries could be on the keyboard as well as a basic mother tongue format. (Today, QWERTY nearly blankets the world with its fixed letter layout. A language that has many characters or letters could well use up all three formats for the language to be expressed.

The present multiple format typewriter could also be used as a secret code machine. The operator would type in the form of the contents but would be touch typing as though in the QWERTY format. Translation at the other end would reverse this process.

Figure 8:
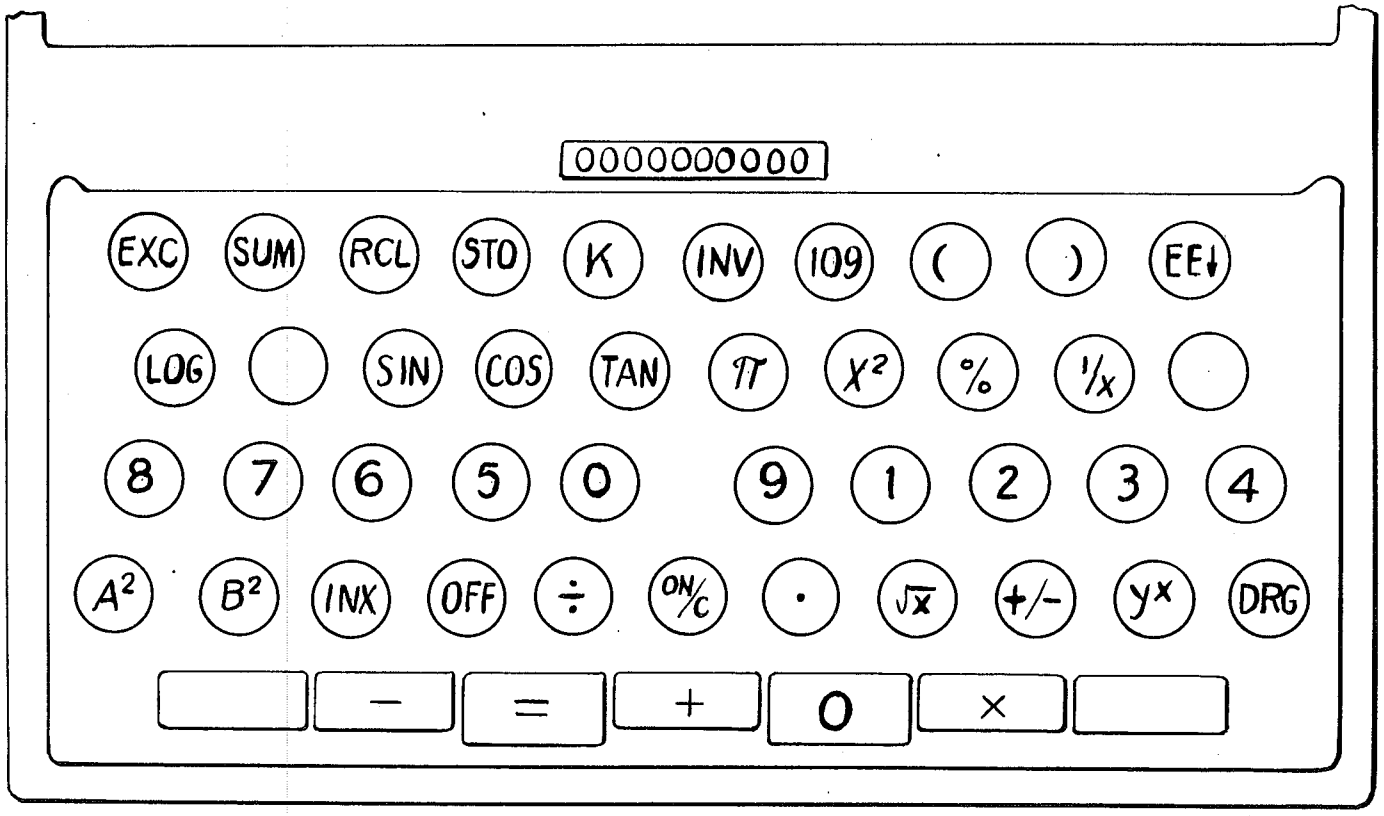
FIG. 8 is a plan view of a keyboard similar to that of FIG. 5 but placed in a calculator mode according to the invention.

The third format can be used as an extensive calculator as seen in FIG. 8. Wiring up for the keyboard display of the numbers and the many mathematical signs can be done with the use of display elements as in the format letter change described above. The actual displaying of the problem in numbers and then giving the answer in the display, as on the regular hand held calculator, would be performed in the topmost row of the typwriter, computer, etc., where the ordinary numbers of the machine are usually found. When selecting the calculator format, the number display on the top row would fade out, and the regular digit, moving decimal display would take over.

Figure 7:
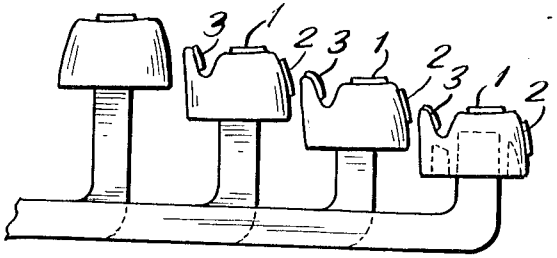
FIG. 7 is a side view of key members for displaying three different letter formats according to the invention.
Figure 23:
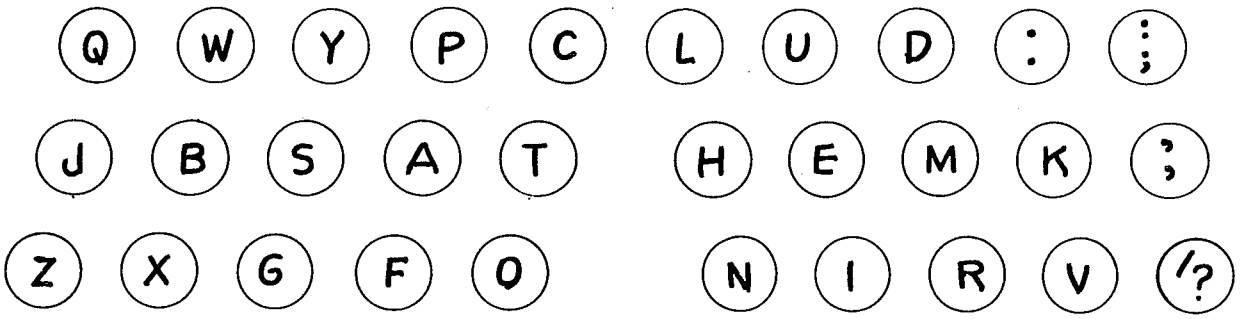
FIG. 23 is a plan view of a keyboard wherein keys are lettered according to a people's or high-frequency letter cluster format according to the invention.

FIG. 7 shows an elongated plastic letter key especially shaped to show three letters, each of a different format. The new language-adapted format would take the place of the standard (QWERTY) letters on the center of the keys, the standard letters are on the front slope, and the third format letters (see FIG. 23) are on the back slope.

III. A PROCESS FOR DEVELOPING AN IDEAL FORMAT FOR ANY LANGUAGE

In the 108 years since the introduction of the Typewriter, any attempts to design a new format were always based on empirical, hit or miss, methods of setting up new letter layouts. The present process provides a scientific approach towards creating a new format that can be a direct reflection of the idiosyncracies of the language under study, and will provide the optimum or ideal format for that language. Here, English is given, and an attempt is made to provide a French one, also.

Figure 9:
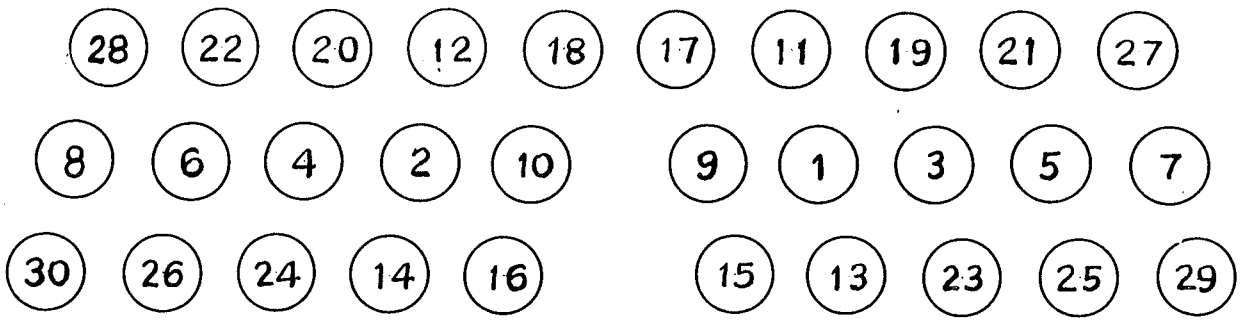
FIG. 9 is a plan view of a keyboard on which keys are assigned finger priority numbers according to the invention.

Upon realizing that there is a natural priority order of the fingers reaching the keys, considering them blank, from the most easy to the most difficult (see FIG. 9), it will be appreciated that such order universally suits all human beings. Numbering the keys by this order allows for precisely matching them to the numbered letters of the given frequency alphabet of a language, providing a Primary or "Perfect" Format shown in FIG. 10. But because it does not take into account the high activity of the two index fingers and other factors, 16 rules are provided for revision of the "Perfect" Format.

It is noted that because of the many and complex factors involved in creating the just-right letter layout, an interim format can be provided, called the Intermediate. For those who will construct other foreign language formats, it will seem that this is a Final Format, but after an interim of a few days or weeks, the unconscious part of the mind that one has trained to this thinking, suddenly sees solutions to minor letter changes that were not as apparent as before. Only then will the Final Format come about.

The Final Format itself, ironically, may have several false "arrivals" before the "all clear" is found. That is, the Final Format must be the one to use as a checking format in comparing it to the Standard Format in Tables 6 to 12, below, showing and proving how much better it is than QWERTY. The very process itself of going through those tables; of drawing up eight various format layouts in FIGS. 10 to 18 with their letters, numbers, and percentage values; and perhaps having memorized the Frequency Alphabet by letter and number, is such an educational process that it tends to lend continual and further discernment in refining the Final Format down through several last editions to one of no further change—let it be called The Scientific Format.

(1) The Official Numbered Frequency Alphabet of the English Language can be found in any book on Cryptography. It has been counted, refined, and proven correct over several centuries of code making and breaking, and it is of vital use in forming a new format.

TABLE ONE

THE OFFICIAL FREQUENCY ALPHABET OF THE ENGLISH LANGUAGE (NUMBERED)

| | | | | | | | | | | |
|---|---|---|---|---|---|---|---|---|---|---|
| Accumulated | (30) | (29) | (28) | (27) | (26) | (25) | (24) | (23) | (22) | (21) |
| | E | T | A | O | N | R | I | S | H | D |
| Frequency | (1) | (2) | (3) | (4) | (5) | (6) | (7) | (8) | (9) | (10) |
| Accumulated | (20) | (19) | (18) | (17) | (16) | (15) | (14) | (13) | (12) | (11) |
| | L | F | C | M | U | G | Y | P | W | B |
| Frequency | (11) | (12) | (13) | (14) | (15) | (16) | (17) | (18) | (19) | (20) |
| Accumulated | (10) | (9) | (8) | (7) | (6) | (5) | (4) | (3) | (2) | (1) |
| | , | V | . | K | X | J | Q | Z | ; | ? |
| Frequency | (21) | (22) | (23) | (24) | (25) | (26) | (27) | (28) | (29) | (30) |

As is seen, the Frequency Use Alphabet is recorded numerically as the descending order of the most used letters in words, down to the least. Whereas the Accumulated Alphabet (created for convenience here) counting up from the least used key to the most, indicates numerically the relative active use of the letters in this reverse order shown. Unlike the former, its numbers can be added to show a crude relative relationship between keys and rows. The four most used punctuation marks have been placed by the Inventor's own survey.

TABLE TWO

FREQUENCY ALPHABET IN NUMERICAL FREQUENCY OF OCCURRENCE

| Letter | Freq. Occur. in 1000 Words | Freq. Occur. in 1000 Letters | Letter | Freq. Occur. in 1000 Words | Freq. Occur. in 1000 Letter |
|---|---|---|---|---|---|
| 1 E | 591 | 131.05 | 16 G | 90 | 19.94 |
| 2 T | 473 | 104.68 | 17 Y | 89 | 19.82 |
| 3 A | 368 | 81.51 | 18 P | 89 | 19.82 |
| 4 O | 360 | 79.95 | 19 W | 68 | 15.39 |
| 5 N | 320 | 70.98 | 20 B | 65 | 14.40 |
| 6 R | 308 | 68.32 | 21 , | (44) | (10.00) |
| 7 I | 286 | 63.45 | 22 V | 41 | 9.19 |
| 8 S | 275 | 61.01 | 23 . | (30) | (6.00) |
| 9 H | 237 | 52.59 | 24 K | 19 | 4.20 |

TABLE TWO-continued

| FREQUENCY ALPHABET IN NUMERICAL FREQUENCY OF OCCURRENCE | | | | | |
|---|---|---|---|---|---|
| Letter | Freq. Occur. in 1000 Words | Freq. Occur. in 1000 Letters | Letter | Freq. Occur. in 1000 Words | Freq. Occur. in 1000 Letter |
| 10 D | 171 | 37.88 | 25 X | 7 | 1.66 |
| 11 L | 153 | 33.89 | 26 J | 6 | 1.32 |
| 12 F | 132 | 29.24 | 27 Q | 5 | 1.22 |
| 13 C | 124 | 27.58 | 28 Z | 3 | 0.77 |
| 14 M | 114 | 25.36 | 29 ; | (1) | (0.05) |
| 15 U | 111 | 24.59 | 30 ? | (1) | (0.03) |

(2) Setting up a Universal Finger-Priority, Numbered-Format for all Keys, 1 to 30; which includes four punctuation marks.

Figures 11, 12:
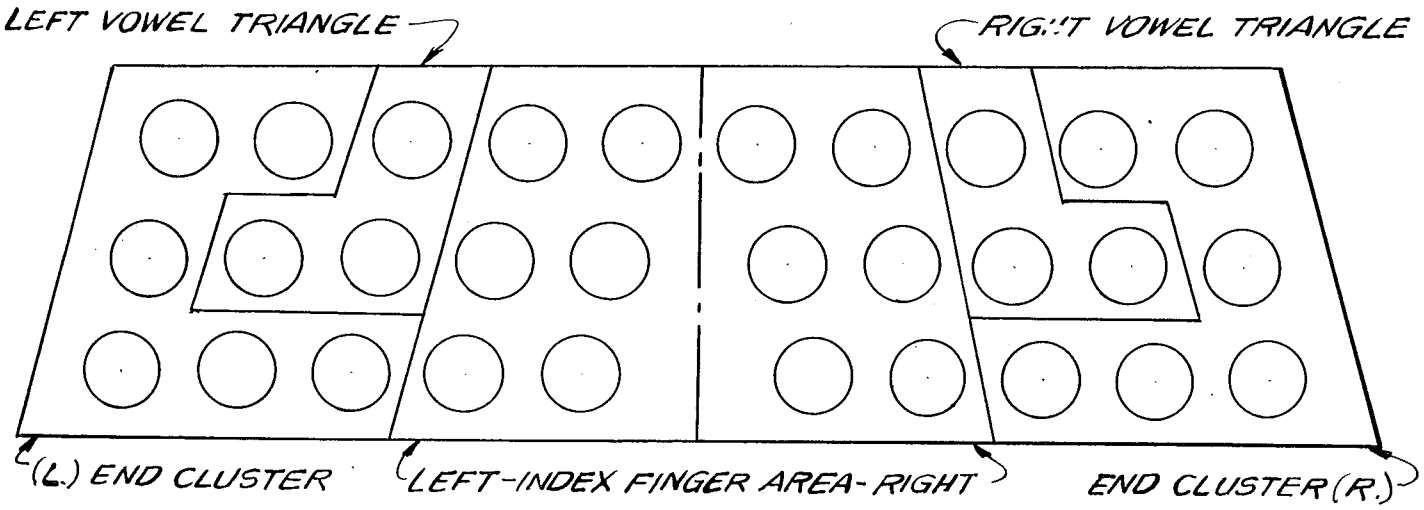
FIG. 11 shows the frequency of use of letters and characters in the English language.
FIG. 12 is a plan view of a keyboard on which key members are segregated within areas according to the invention.
Figure 13:
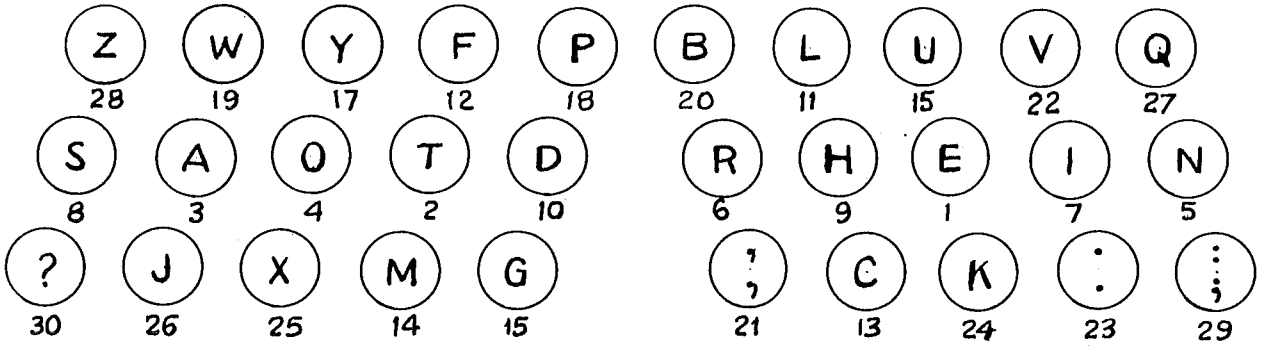
FIG. 13 is a plan view of a keyboard in which keys are lettered in an intermediate format according to the invention.
Figure 14:
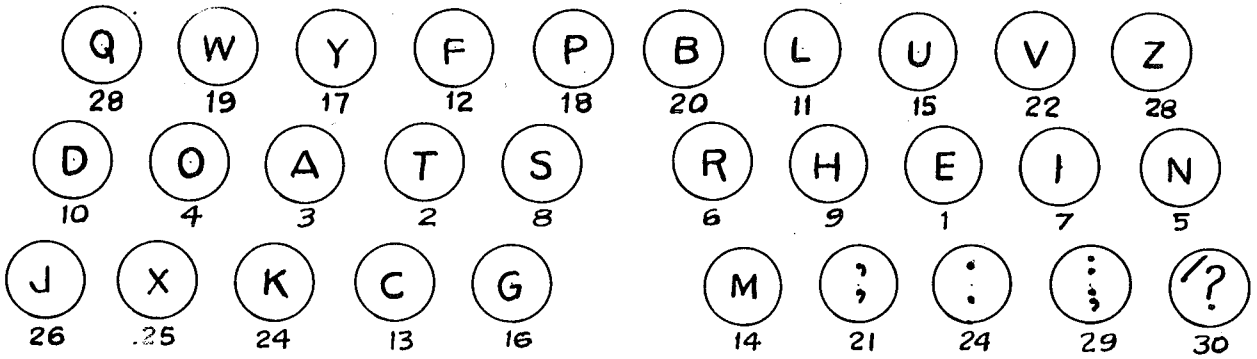
FIG. 14 is a plan view of a keyboard in which keys are lettered in a final English language letter format according to the invention.
Figures 15, 16:
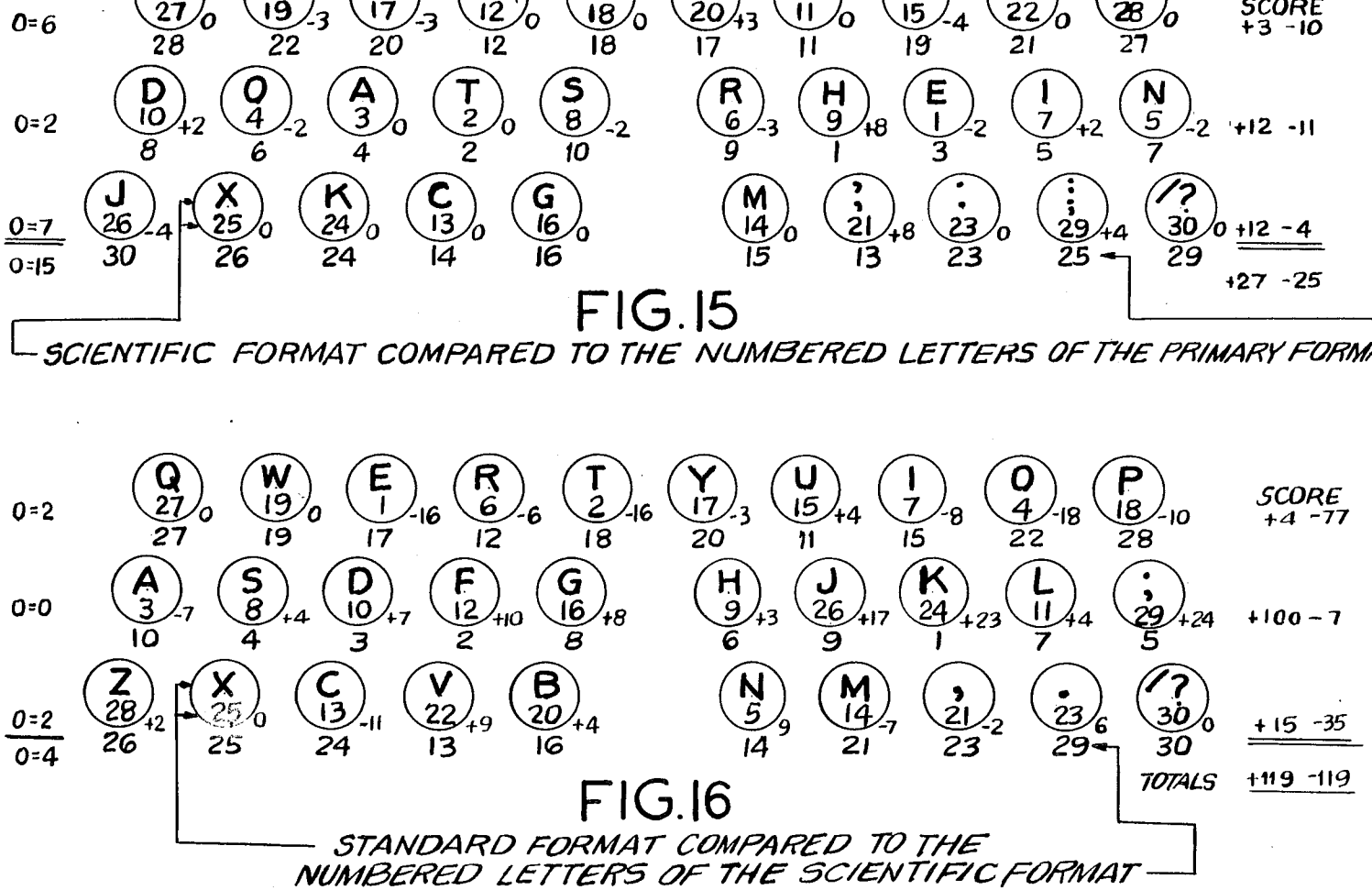
FIG. 15 is a plan view of the keyboard of FIG. 14 with deviations from the primary format of FIG. 10 scored by numbers.
FIG. 16 is a plan view of a QWERTY keyboard on which deviations from the priority numbered letters of the scientific format of FIG. 15 are scored by numbers.

This digital process is worked out by starting with a fully laid out keyboard format on paper, with the keys shown blank, as in FIG. 12. With the two hands set in touch-type position, fingers on the Middle Row, note how the fingers press the most easily accessible keys, alternating hands and fingers by consecutive numbers, down to the most inaccessible key—#30. This order is to be marked on the blank format diagram, FIG. 12, as #1 for the index finger of the right hand; #2, same finger, left hand. #3 would be 2nd finger, r.h.; #4 2nd finger, 1.h., etc., until the 15 keys for each hand are completely worked out on the diagram, now complete with all 30 numbers, as visualized in FIG. 25.

The resulting Finger-Priority, Numbered-Format is a Universal one and applies to the natural action of the human fingers seeking the keys.

Figure 10:
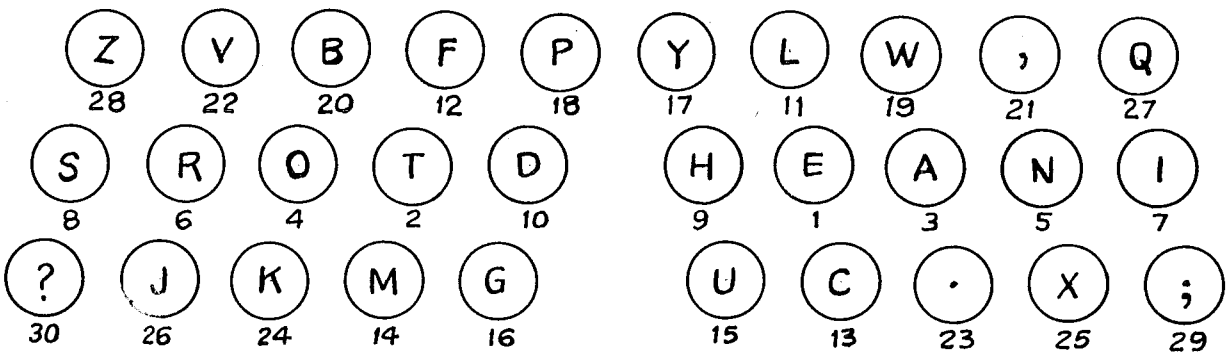
FIG. 10 is a plan view of a keyboard on which the keys are lettered according to the frequency of use of the letters in the English language and the number priority of the keys shown in FIG. 9.

(3) Forming the "Perfect" Primary Format. This is a creative procedure done by combining the Numbered Letters of the Frequency Alphabet in Table 1 with the Numbered Format in FIG. 9 as filled in the blank-key diagram by instructions in FIG. 25. Combined, FIG. 10 shows this Letter-Number arrangement that results in the "Perfect" or Primary Format. It is not an easily useable one, however, as it violates in several ways other rules that must be worked out.

(4) 16 Rules for Letter Layout in the Three Main Areas of Differing Activity for each hand.

FIG. 12 shows three designated areas for each hand, calling for different letter activity per area. These will result in design placement of these letters, some general, some near-specific, and indicating their derived rules for their true and proper placement.

TABLE THREE

A. The Index Finger Areas. This is the heart of the touch system, where the activity of the two index fingers control six letters each; twelve in all, nearly half all letters used. Because of their high activity these rules for letter placement come about:

Rule #1. Ideally, no one index finger should have to strike any two of the six letters consecutively—making a minimum of bigrams.

Rule #2. Only consonants should be placed in these two areas.

Rule #3. Conversely, no vowels should exist in these areas.

Rule #4. A maximum of bigrams across the centerline are desirable, in the action of one index finger following the other.

B. The Vowel Triangles. The logic of digital activity indicates that the vowels (six) be only placed in designated areas shown in FIG. 12, outside the index finger area. This will result in their optimal ease of use.

Rule #5. In these areas, the four most used vowels shall be placed in the two areas designated on the Middle Row, two letters each, left and right.

Rule #6. The least used vowels, the U and the Y, shall be placed in the single designated areas, Top Row, with the U to be placed across the centerline from where the Q is placed.

C. The Cluster of Five Remaining Keys on each side. These are controlled by the 2nd, 3rd, and 4th fingers, with various degrees of activity.

Rule #7. The two sets of outside letters in the Top and Bottom Rows, all controlled by the weak 4th finger, shall have letters of the lowest activity, with the Bottom Row holding the least.

Rule #8. The two single letters of the third fingers, Top Row, shall be of lower middle activity, while the single two letters in the Bottom Row shall be of lowest activity.

Rule #9. The two single letters of the second fingers, Bottom Row shall be of low activity.

Rule #10. The two single outside letters of the Middle Row shall be of high activity.

General Rule #11. Any letters of the same finger number may be moved left or right (swapped, in some instances) and can be considered a zero move.

General Rule #12. All ten letters of the Middle Row shall be taken from the first ten letters of the frequency alphabet, and shall be considered of equal activity, being directly available.

General Rule #13. Moving of any letter from its place in the Primary Format (See FIG. 10) with its perfect Unity wherein Frequency Number and Digital Priority Number are combined, shall be done by constantly evaluating these two factors in moving that letter to the next key.

General Rule #14. Where possible, combinations of adjacent letters should be sought to simulate word-sounds to allow for easy memorizing of keyboard.

General Rule #15. Where feasible, a letter that is close in number activity to a letter of the Standard Format may remain in place.

General Rule #16. When a moved letter displaces another with only one number difference in digital frequency, it is considered a "zero" move.

(5) Applying the 16 Rules of Letter Placement to make the Intermediate Format; altering the Primary Format.

TABLE FOUR (The given letter displaces the next one down in the group.)

| Row | Letter Moved | Frequency Number | Frq. No. Moved To | Reason for Move | Rule Number |
|---|---|---|---|---|---|
| Middle | E | 1 | 3 | Out of Index Area into Vowel Trngl | #3 & #5 |
| ↓ | A* | 3 | 4 | To opposite number - a change-over | #11 |
| ↓ | O | 4 | 6 | One Key move - Still in Vowel Trngl | #5 |
| ↓ | R | 6 | 9 | Cross Ctrline - Makes 17 Bigrams-CR, | #4 & #2 |
| ↓ | H | 9 | 1 | One Key move - Makes 6 Bigrams-TH, | #4 & #2 |

TABLE FOUR-continued (The given letter displaces the next one down in the group.)

| Row | Letter Moved | Frequency Number | Frq. No. Moved To | Reason for Move | Rule Number |
|---|---|---|---|---|---|
| ↓ | +I | 7 | 5 | Into Vowel Triangle Exchange | #5 |
| ↓ | +N | 5 | 7 | Out of Vowel Triangle Exchange | #5 |
| Top | U | 15 | 19 | Bottom Row to Top, into Vowel Trngl | #6 |
| ↓ | W | 19 | 22 | Readability - As on Std. Format | #14 #11 #15 |
| ↓ | V* | 22 | 21 | To opposite number - a change-over | #14 |
| ↓ | , | 21 | 15 | To Bottom Row - Low Activity | (#2) & #13 |
| ↓ | +Y | 17 | 20 | Out of index Area-Cross Ctrln-Vowel Trngl | #6 |
| ↓ | +B | 20 | 17 | Into index Area - Bad Combo of BR/BL | #2 & #4 |
| Bottom | C* | 13 | 14 | Swap, makes good bigrams.CR/CH/CL | #4 |
| ↓ | M* | 14 | 13 | Swap, makes better bigrams.Total = 8 | #4 |

Note: *indicates Swap places for two letters, or change-over for a single letter. In both instances, a letter moving across the centerline to letter 1 digit removed, same finger other hand, is considered 'no-change' from the "Perfect" or Primary Format.
Note: + indicates that these two letters exchange places only.

(6) Applying the 16 Rules of Letter Placement to make the Final Format, by altering the Intermediate Format.

The first emphasis, on explaining this process, is to show clearly how the ideal English Format could come about. The second emphasis is to show that it further acts as a guide, to those who will go beyond its one example, to make custom formats for other languages. It may seem unscientific to show what seems to be a single process of keyboard letter development, in going beyond the Primary Format, to make it a two step process, but practicality rules otherwise.

Having made multiple blank copies of the new split keyboard layout, sans letters, they lent for facile attempts, otherwise forgotten, of changing the Primary Format. Later on, a few of them became part of the recorded changes. These sum up, with other current observations, to give the last ten listed below, as the "Final" Format. See FIG. 14.

(7) Checking the Letter Layout of the Scientific Keyboard. There are several methods of checking the efficiency of the New Keyboard Layout, and always in comparison with the Standard Keyboard Format. These methods are:

(A) Design check by row on row sentence comparison.

(B) Design check of maximum and minimum bigrams in the Index Finger Areas.

(C) Design Check by Efficient use of Cryptography lists typed on the middle line.

(D) Design check by percentage ratings through Horizontal and Vertical analysis.

(A) Design Check by Row on Row Sentence Comparison. Note that the sentence occupies three levels. Each typed letter is assigned to the row it occupies on the keyboard. Negative rating is given towards the fingers having to use the Top and Bottom Rows in the letters to complete the sentence; with the Middle Row letters counted as zero, where the fingers remain or return to these keys.

TABLE FIVE

| Row | Letter Moved | Frequency Number | Frq No. Moved To | Reason for Move | Rule Number |
|---|---|---|---|---|---|
| Bottom | J | 26 | 30 | Make room for X | #13 |
| ↓ | ?* | 30 | 29 | Old Std. Format place and a Swap | #15, #11 #7 |
| ↓ | . | 29 | 25 | Higher Activity | #13 |
| ↓ | X* | 25 | 26 | Old Standard Format Place. | #15 |
| ↓ | +M | 14 (on13) | 21 | Exchange with comma. Readability | (#14) |
| ↓ | +, | 21 (on15) | 13 | Exchange with M.Readability | (#14) |
| Top | Q* | 27 | 28 | Old Std Format, Swap, Readability | #15, #14 |
| ↓ | Z | 28 | 27 | Swap, Readability | #11, (#14) |
| Middle | +S | 8 | 10 | Swap Readability | #11, #14 |
| | +D | 10 | 8 | Swap Readability | #11 #14 |

TABLE SIX

```
Row
                                  STANDARD KEYBOARD
Top   OW I  T  E T   E  OR      OO    E  TO  O  E TO T  E  I  O  T  E P  RTY
Mid        S  H   I    F   ALL G   D                    H  A D  F  H   A
Bot   N              M                  M N    C M
                                 Analysis of the Above
Top   11  1    1 1   1                                                      28
Mid        0    0    0 1    11        11    1    11    1 1   11  1 1    1    1    1 1   1 111   =15
Bot   1                 1    0    000  0 0                     0   0 0   0    0    0            7
                                          1 1       1 1                                  1   1=35
                                                                                            0=15
                Score: 15 No moves   35 Moves, an efficiency rating of 30%.      Total        =50
                                      NEW KEYBOARD
Top     W                F     LL                                F     P     Y
Mid   NO   IS THE TI  E   OR A     OOD   EN TO   O   E TO THE AID O   THE   ART
Bot                  M            G     M        C M
```

TABLE SIX-continued

| Row | | |

TABLE NINE-continued

| Standard Keyboard | Scientific Keyboard |
|---|---|
| on | ON |
| At | AT |
| nD | ND |
| St | ST |
| eS | ES |
| en | EN |
| oF | Of |
| te | TE |
| eD | ED |
| or | OR |
| ti | TI |
| Hi | HI |
| AS | AS |
| to | TO |
| Score: 1 of 2 letters | Score: 19 of 2 letters |
| 10 of 1 letter | 1 of 1 letter |
| 9 of no letter | 20 |
| 20 | |
| Efficiency rating of 30& | Efficiency rating of 95% |

Twenty of the most common three letter part-words for comparison are:

TABLE TEN

| Standard Keyboard | Scientific Keyboard |
|---|---|
| tHe | THE |
| inG | INg |
| And | AND |
| ion | ION |
| ent | ENT |
| For | fOR |
| tio | TIO |
| ere | ERE |
| Her | HER |
| Ate | ATE |
| ver | vER |
| ter | TER |
| tHA | THA |
| Ati | ATI |
| HAt | HAT |
| erS | ERS |
| HiS | HIS |
| reS | RES |
| iLL | Ill |
| Are | ARE |
| Score: 4 of 2 letters | Score: 16 of 3 letters |
| 10 of 1 letter | 3 of 2 letters |
| 6 of 0 letter | 1 of 1 letter |
| 20 | 20 |
| Efficiency rating of 23% | Efficiency rating of 95% |

(C3) Design Check from Official Letter Combination Lists. Twenty of the most common two-letter words for comparison are:

TABLE ELEVEN

| Standard Keyboard | Scientific Keyboard |
|---|---|
| oF | Of |
| to | TO |
| in | IN |
| it | IT |
| iS | IS |
| be | bE |
| AS | AS |
| At | AT |
| So | SO |

TABLE ELEVEN-continued

| Standard Keyboard | Scientific Keyboard |
|---|---|
| we | wE |
| He | HE |
| by | by |
| or | OR |
| on | ON |
| Do | DO |
| iF | If |
| me | mE |
| my | my |
| up | up |
| An | AN |
| Score: 1 of 2 letters | Score: 12 of 2 letters |
| 8 of 1 letter | 5 of 1 letter |
| 11 of 0 letters | 3 of 0 letters |
| 20 | 20 |
| Efficiency rating of 25% | Efficiency rating of 72% |

(D) Design Check by Percentage Ratings through Horizontal Analysis. Comparison of the New Format and the Standard Format to the Perfect Format.

When the numbered letters of a format are compared to those of the Perfect Format, the disparity that is less than the perfection shows up in the format compared. The New Format does well in comparison, as can be seen in the table below. The Standard Format shows up as a series of wild numbers, when compared, indicating the similar disorder of the letters, as seen below.

TABLE TWELVE

| | | | | | | | | | | |
|---|---|---|---|---|---|---|---|---|---|---|
| New Format | H | T | E | A | I | O | N | D | R | S |
| Digital Number | (9) | (2) | (1) | (3) | (7) | (4) | (5) | (10) | (6) | (8) |
| | | * | | * | | | | | | |
| Perfect Format | E | T | A | O | N | R | T | S | H | D |
| Digital Number | (1) | (2) | (3) | (4) | (5) | (6) | (7) | (8) | (9) | (10) |
| | | | | | | | | | * | |
| Standard Format | J | F | K | D | L | S | ; | A | H | G |
| Digital Number | (26) | (12) | (23) | (10) | (11) | (8) | (31) | (3) | (9) | (16) |
| New Format | L | F | M | , | M | G | B | P | U | Y |
| Digital Number | (11) | (12) | (14) | (21) | (14) | (16) | (20) | (18) | (15) | (17) |
| | * | * | * | * | | * | | * | | |
| Perfect Format | L | F | C | M | U | G | Y | P | W | B |
| Digital Number | (11) | (12) | (13) | (14) | (15) | (16) | (17) | (18) | (19) | (20) |
| | | | * | | | | * | | | |
| Standard Format | U | R | M | V | N | B | Y | T | I | E |
| Digital Number | (15) | (9) | (14) | (22) | (7) | (20) | (17) | (18) | (7) | (1) |
| New Format | V | W | . | K | ; | X | Z | Q | ? | J |
| Digital Number | (22) | (19) | (23) | (24) | (29) | (25) | (28) | (27) | (18) | (26) |
| | * | | * | * | * | * | * | * | * | * |
| Perfect Format | , | V | . | K | X | J | Q | Z | ; | ? |
| Digital Number | (21) | (22) | (23) | (24) | (25) | (26) | (27) | (28) | (29) | (30) |
| | | | | | | | | * | | |
| Standard Format | O | W | , | C | . | X | P | Q | ? | Z |
| Digital Number | (4) | (19) | (21) | (13) | (23) | (25) | (18) | (27) | (30) | (28) |

Note
*denotes Letter Perfect (D2) Design Check by Percentage Ratings through Horizontal Analysis. The Scientific Format compared to the Numbered letters of the Primary or "Perfect" Format, FIG. 10.

Here is a more dramatic presentation of the preceding, showing the final layout of the Scientific Format with the proper frequency number beneath each letter. Below that is the frequency number of the Primary or Perfect Format that either agrees with the above number when the letter remained the same, or the number of the Perfect Format letter that was displaced by the Scientific Format letter. The small number between them, to the right indicates the numerical difference between the two. Zero, if the letter has remained unchanged, or taken from the opposite side, one number removed. If the number shows a plus sign, it shows the number of steps on the frequency scale the slower letter has jumped to a more active position. Conversely, a negative sign shows that an active letter has assumed a position that-amount-down-the-scale to a more awkward position relative to its use.

Under this analysis, the Ideal Format lives up to its name, with 15 Zeros, or marked unchanged, with 6 actually so and 9 swapped to the other finger. Of the 15 changed, number differences were mostly slight, with 6—2's + or −; 3—4's + or −; and 2—8's −; which total 52 + or −, nearly evenly divided.

(D3) Design Check by Percentage Ratings. The Standard Format compared to the Numbered Letters of the Scientific Format, FIG. 16.

Comparing the Standard Format to its new rival the Scientific Format, shows it to be a relatively awkward groupings of letters. Listing its totaled deviation from the Scientific Format is best shown in a small table, viz.:

| Row | + | − |
|---|---|---|
| Top | 1-4 | 7-77 |
| Mid | 9-100 | 1-7 |
| Bot | 3-15 | 5-35 |
| | 13-119 | 13-119 |

Totaling 238 on 26 keys, whereas in the comparison in D2 above of the Scientific Format against the Primary Format, the score was 52 on 15 keys. Note that many letters are off their numerical mark by + or —16, 17, 18, and 22. All proving that every minute of typing on the Standard Format is a battle of forcing ones fingers to a constant series of inefficient movements.

Letter Use per Thousand, with Row Percentage Use of the Standard Format compared to the Scientific Format. See FIG. 17 for Standard Format and FIG. 18 for New Format.

The listed numbers under each letter are taken from Table Two above as being their average use per thousand. They may also be read as actual percentages by moving one decimal to the left. This is how the row ratings on each side have been shown. The Standard "QWERTY" Format shows up in greatly unbalanced proportions, with nearly 53% of the use of letters on the Top Row and 32% on the Middle Row. All across the last hundred years, it perhaps allowed for greater efficiency, for the millions who have been trained to this format, to use the upper line as the "home key row" rather than the Middle Row. Further analysis shows what has long been suspected, that the left hand does more of the work in a ratio of 60% for it and 40% for the more dextrous right hand.

In Comparison, the New Scientific Format lives up to its name, showing the 75% of all letters used are right in the Middle Row, immediately at the eight fingers. The need to use the Top and Bottom Rows is reduced to less than 17% and 10% respectively. The two sides, total up nearly 50% to 50%. This is accounted for by the even distribution of numbers, right and left, in setting up the Priority Fingered Format in FIG. 9. The actual worldwide use of the present Scientific Format will get its final honing by minds-other-than-one before its being acclaimed, and it may be that this balanced situation of the hands can be corrected to the proper bias for the right hand.

Further comparison shows up how little actual work is being done by the right hand in its own "home row", that of 9%, against a near 23% for the left, and 32% for the immediate control of the Top Row of the Standard Format. Whereas, on the Scientific Format in the "home row", the right hand has greater control use of the keys for it alone than do both hands on the same row on the Standard Format.

Of course the obvious "secret" of the Scientific Format's superiority lies in the placement of the ten first letters of the Frequency Alphabet on the Middle Row. Considering the natural placement of the index finger, the format allows it to rapidly move up and down, nearly as fast as sidewise, to reach L—3.4%; F-2.9% and (below) C—2.7% and comma—1.0%, all equaling 10%. Adding this amount to the 75% gives a total of 85% use of all letters by 14 letters, leaving a mere 15% left of work use for the other 13 letters and 3 Punctuation Marks.

B. The Process for evolving the ideal Format for the French Language.

Introduction: Following the outline of this Process, French has been chosen as the next language for which to customize a scientific Format. It is here only being carried as far as the Intermediate Format, which should give a good outline as to what a format should look like other than the English one evolved. A native French person, skilled in the use of this process, then can bring about the Final Format.

The Frequency Alphabet for the French Language, along with Spanish, Italian, and German are found in books on Cryptography, located, e.g., in the Library of Congress, Washington, D.C. All four languages have 8 or 9 out of 10 of the first letters of the English Frequency Alphabet. In the French, D(#10) (English) became #11, and H(#9) became #23, the latter letter alone giving good indication that foreign languages need least of all the "standard" format.

Figures 19, 20:
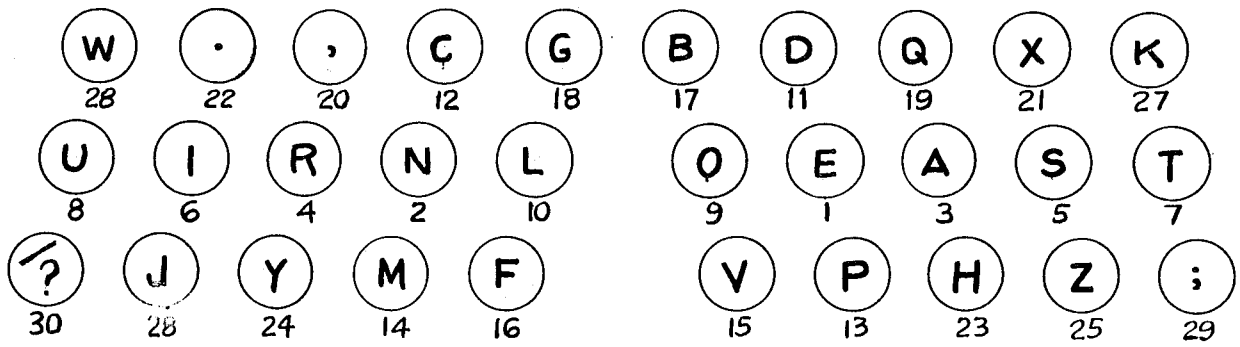
FIG. 19 represents the frequency alphabet of the French language.
FIG. 20 is a plan view of a keyboard lettered in a primary format of the French language, wherein the frequency of use of each letter as shown in FIG. 19 corresponds to the finger priority numbered format of FIG. 9.

As in working out the English Format, the letters of the Frequency Alphabet, with their numbers, are matched to the numbers of the Priority Numbered Format. That format being a Universal one, applies, then, to the French format formation, also. The French Frequency Alphabet is shown below, and for comparative purposes it will be repeated in the drawing as FIG. 19. The percentage values in Table 14 will be used later to indicate the actual efficiency of this new evolving format in FIG. 21. So the combining of the French Frequency Alphabet, Table 13 and FIG. 19, with the Universal Priority Numbered Format, FIG. 9, will automatically lay out a fixed "perfect" Primary Format in that language.

TABLE THIRTEEN

THE NUMBERED FREQUENCY ALPHABET OF THE FRENCH LANGUAGE

| | | | | | | | | | |
|---|---|---|---|---|---|---|---|---|---|
| E | N | A | L | S | I | T | U | O | L |
| (1) | (2) | (3) | (4) | (5) | (6) | (7) | (8) | (9) | (10) |
| D | C | P | M | V | F | B | G | Q | , |
| (11) | (12) | (13) | (14) | (15) | (16) | (17) | (18) | (19) | (20) |
| X | . | H | Y | Z | J | K | W | ; | ? |
| (21) | (22) | (23) | (24) | (25) | (26) | (27) | (28) | (29) | (30) |

Compare the above table with its English counterpart in Table One. Some of the more extreme suprises are noted below.

TABLE FOURTEEN

| Letter | Eng Freq Number | Fr. Freq Number | Greater Activity | Less Activity | Letter | Eng Freq Number | Fr. Freq Number | Greater Activity | Less Activity |
|---|---|---|---|---|---|---|---|---|---|
| T | 2 | 7 | | 5 | P | 18 | 13 | 5 | |
| O | 4 | 9 | | 5 | V | 22 | 15 | 7 | |
| H | 9 | 23 | | 14 | Q | 27 | 19 | 7 | |
| W | 19 | 28 | | 9 | X | 26 | 21 | 5 | |
| | | | | | U | 15 | 8 | 7 | |

Incorporated by reference herein is a Spanish book on Cryptography of various European languages, including the French, by Arturo Fuentes Rabe, L.O.C, #Z104/.F95, page 166. Graphs and charts in the reference relating to frequency of use of letters in the French language can be used, at least up to the Intermediate Format, which claims no finality.

TABLE FIFTEEN

THE FRENCH FREQUENCY ALPHABET IN PERCENTAGE USE PER LETTER OF OCCURENCE
(With per 1000 average shown as per 100)
(+1.3% = Punct. Mks.)

| Letter | Freq. of Occur. in 100 Words (%) | Letter | Freq. of Occur. in 100 Words (%) |
|---|---|---|---|
| 1 E | 16.2 | 16 F | 1.4 |
| 2 N | 8.6 | 17 B | 0.9 |
| 3 A | 7.1 | 18 G | 0.8 |
| 4 R | 6.8 | 19 Q | 0.7 |
| 5 S | 6.7 | 20 , | 0.6 |
| 6 I | 6.7 | 21 X | 0.5 |
| 7 T | 6.6 | 22 . | 0.5 |
| 8 U | 6.6 | 23 H | 0.5 |
| 9 O | 6.6 | 24 Y | 0.4 |
| 10 L | 5.7 | 25 Z | 0.2 |
| 11 D | 4.7 | 26 J | 0.2 |
| 12 C | 3.9 | 27 K | 0.1 |
| 13 P | 2.9 | 28 W | 0.1 |
| 14 M | 3.2 | 29 ; | 0.1 |
| 15 V | 1.9 | 30 ? | 0.1 = 101.3% |

Table 16 reflects the Process of converting the Primary Format into the Intermediate Format. The 16 rules of Letter Layout, which, again, are of Universal application, are followed as set out in Table Three. As a result, the Intermediate Format for the French Language is found in FIG. 21. The 19 moves to do so (as against the English 15, see Table 4) are listed below, letter by letter.

TABLE SIXTEEN

LETTERS MOVED ON PRIMARY FORMAT TO CREATE INTERMEDIATE FORMAT
(The given letter displaces the next one down in the group)

| Row | Letter | Freq. | Freq. No. Moved To | Reason For Move | Rule Number |
|---|---|---|---|---|---|
| Mid | E | 1 | 5 | Moved 1 to Rt. into Vowel Triangle | #5 #14 |
| ↓ | S | 5 | 10 | Moved to left Index area | #14 |
| ↓ | L | 10 | 8 | Displaces U, which must move | #14 |
| ↓ | U | 8 | 19 | Moved to Vowel Triangle | #6 |
| Top | Q | 19 | 15 | To Bottom Row, Medium Use | #3 #13 |
| Bot | V | 15 | 11 | To allow D to move down, Medium activity | #13 |
| Top | D | 11 | 9 | Displaces O, which must move | #14 |
| Mid | O | 9 | 4 | Moved to Vowel Triangle | #5 |
| Mid | R | 4 | 1 | Moved to Index area | #14 #2 |
| Bot | H | 23 | 22 | Moved 1 Number Readability | #16 #14 #8 |
| Top | . | 22 | 25 | To low activity | #15 #8 |
| Bot | Z | 25 | 27 | To low activity | #13 #14 #7 |
| Top | K | 27 | 24 | Replaces Y, which must move | #9 |
| Bot | Y | 24 | 20 | To Vowel Triangle | #6 |
| Top | , | 20 | 23 | To Standard position | #15, #9 |
| Bot | ;* | 29 | 30 | Swap with ? Old Standard position | #11 #15 #7 |
| Bot | ?* | 30 | 29 | Swap with; Old Standard position | #11 #15 #7 |
| Bot | M* | 14 | 13 | Swap with P, Old Standard position | #15 #16 |
| Bot | P* | 13 | 14 | Swap with M, Better Bigrams | #4 #16 |

Following in Table 17 are lists of bigrams, short words, and trigrams of the French Language. Missing are certain bigrams that just don't exist, as in English. Thus, the letter breakdown in the area of the two index fingers does not have the same meaningful consideration as that same area does in English.

TABLE SEVENTEEN

| Bigrams | 2 Letter Words | Trigrams |
|---|---|---|
| ES | AN | ENT |
| EN | AU | EDE |
| LE | CE | LES |
| DE | CI | LLE |
| ON | DE | QUE |
| OU | DU | AIT |
| RE | EN | EME |
| NE | ET | ION |
| SE | IL | EUR |
| EL | JE | ELL |
| AI | LA | SSE |
| TE | LE | EST |
| LA | MA | DAN |
| IT | | DEL |
| ER | NE | MEN |
| ED | NI | DES |
| QU | NU | TIO |
| ME | ON | ESE |
| KM | OU | ANS |
| AN | SA | |
| ET | SE | |
| EU | SI | |
| | TA | |
| | TE | |

TABLE SEVENTEEN-continued

| Bigrams | 2 Letter Words | Trigrams |
|---|---|---|
| | TU | |

Single Letter Words are: A,- O,- Y.
Frequency of the use of the letter E is 17% of all letters used.
Most common letters to begin a word: D L E P A C B M R I F, etc.
Second such letter: E A A U N R I T, etc.
Third such letter: S E U N T I R, etc.
Initial Consonant Bigrams: BL, BR, PR, FL, VR CR, CL, CR, GL, GR, TR, DR, CH, PH, TH, SC, SP, ST.

SIMILARITIES AND DIFFERENCES OF PRIOR ART (#1) D. B. Webster—U.S. Pat. No. 1,013,084—Dec. 26, 1911. A platen shifting mechanism which allows shifting to either side of the regular printing line for incidental use of certain letter variations.

Refutation—An involved platen shifting mechanism with an extra row of letters on the side of the regular row. Nothing is indicated here of being able to provide the typewriter with a new letter format—which is a modern disideratum.

(#2) W. Wilson—U.S. Pat. No. 1,610,911—Dec. 14, 1926. A method of shifitng to other rows without moving the platen to "lighten the load on the case controlling key; to reduce the number of type bars . . . ; to avoid . . . shifting the palten or the type bar basket upon case changing operations; and to provide a type bar operating mechanism . . . (that) will serve for a . . . plurality of keys".

Refutation: An involved mechanism to allow the type bar to move up and down without movimg the platen. Extra letters shown on the strike head are not shown to indicate a whole new added format as my invention clearly does. One row of letters folowing the other, is of the same case; either upper or lower, in Wilson's, invention. It would not serve mankind's future needs as my invention does.

(#3) J. Smith—U.S. Pat. No. 1,537,147—May 12, 1925. A complex system of providing the multiple use of letters to shift to one style of letters to another.

Refutation: A clever system of revolving multiple levels of letters to move from one style of lettering to another. Line up of letters on type bar facw 28 shows letters 29, 30, 31, and 32 as being r,d,c, and =, not indicating that they ever would be arranged as allowing for wholey different formats, as my invention does.

(#4) W. B. Kidder—U.S. Pat. No. 1,713,607—May 21, 1929. This invention "relates to improvements in that form of typewriting machines having end thrust bars . . . (and) to combine toggle joint leverage pressure with impact to reduce noise . . . (and) to provide kick back for quickly returning the type to position of rest upon release of keys."

Refutation:—A sliding multi-type bar with rising platen. Nothing is indicated that this system can provide the typewriter with a needed new format.

(#5) W. O. Michelson—U.S. Pat. No. 1,736,125—Nov. 19, 1929. A complex way of bringing about extra lettering, without being clear about thier actual use.

(#5) W. O. Michelesen—U.S. Pat. No. 1,736,125—Nov. 19, 1929. A complex way of bringing about extra lettering without being clear about their actual use. Letter type bar show descending rows of letters as being "a,b,c,d," with the first two letters of one style, smaller, and the next two double, slightly larger.

Refutation: No thought is given that this machine could be arranged to provide a whole new format for the typewriter besides the standard one, or another one besides that one, to boot.

(#6) B. M. Des Jardins—U.S. Pat. No. 1,802,500—Apr. 28, 1931. The principal aim of this invention relates to "type-actions in which two keys are operatively connected to each type-bar to thus reduce the number of type-bars required relative to the keys." Different keys can be actually struck to use other letters on the same type-bar.

Refutation:—Multiple key levers can operate different parts of the same type face, it seems. Such a system has nothing to do with providing a whole new format or formats for the typewriter.

(#7) Gremillet—U.S. Pat. No. 3,944,043—Mar. 16, 1976. An invention "in typewriters comprising groups of type-bars, each group having a distinct printing point, each group being supported by a particular sector of being moveable independently from the others."

Refutation: This is a "Syllabic typewriter having different cases of characters." This seems to be for a printer's professional use or possibely for layouts with different styles of print for newspaper set-up. It has nothing to do with providing a distinctly separate and additional format of alphabetical letters for a typewriter.

General Refutation of all seven patents:—All of these inventions, though having similar elements as my invention, are confined to a narrow range of the use of these elements, with none of them solving the great problem of today of clearly providing another format, or formats, right on the present typewriter (in its future manufacture) with its standard format, to allow for others to learn a new format without being forced to learn the standard one, yet allowing users of the standard format to use the same machine.

All seven call for a different kind of typewriter than what exists on today's market. My invention simpley adds to the present machine, with little change, otherwise. Future manufacture of such a machine could contain two or more formats, adding little to the basic coast, and allowing different types of users to operate it. Universal adoption of this multiple format will allow the Computer, et al., to adopt one of its new scientific formats, whose rational letter layout will allow for greater speed, less errors, and greater ease of learning it in or out of the touch system. (End).

I claim:

1. A multiple format keyboard arrangement adapted for use in a selected one of a number of languages, comprising:

a plurality of manually actuable key members at least some of which correspond to letter and punctuation characters in a given language alphabet, wherein information corresponding to said characters is to be conveyed to information receiving means with which the keyboard arrangement is associated, key member support means for supporting the character key members in a fixed array of three rows forming a bottom row, a middle row and a top row, each of said rows comprising ten character key members arranged consecutively wherein the first five character key members of each of said rows, proceeding from left to right, are for actuation by fingers of the left hand, the fourth and fifth key members being actuable by the left index finger, and the next five character key members of each of said rows are for actuation by fingers of the right hand, the sixth and seventh key members being actuable by the right index finger, information conveying means responsive to actuation of said key members for conveying the information corresponding to the characters represented by said character key members to the information receiving means, character array format selecting means located in the vicinity of said key members for access by an operator, for selecting one of three different character array formats for said character key members wherein at least some of the letter character key members are each caused to correspond to one of at least two different letters in said given language alphabet in accordance with the selected character array format, and said information conveying means conveys the information of the selected letter character to the information receiving means when the corresponding letter character key member is actuated, a first one of said character array formats which is selectable by said character array format selecting means being a QWERTY format, a second one of said selectable character array formats being a language adapted touch-type format wherein the ten consecutive character key members of said middle row each correspond to a different one of the ten most frequently used letters in said given language, and wherein the second, third, eighth and ninth of the ten consecutive key members of said middle row, proceeding from left to right, correspond to vowel letters, the remaining ones of said ten key members of said middle row each corresponding to consonant letters, and only the third and the eighth key members of said top row correspond to vowel letters, the two top row vowel letters being those least used in said given language, and a third one of said selectable character array formats being a high frequency letter cluster format wherein the fourth, fifth, sixth and seventh character key members of the ten consecutive character key members of each of said rows, each correspond to a different one of the twelve most frequently used letters in said given language for selective actuation by the right and left index fingers of the operator's hands, and character indentifying means for indicating, for each of said character key members, the character to which that key member corresponds in the format selected by said character array format selecting means.

2. A multiple format keyboard arrangement according to claim 1, wherein said information conveying means includes a number of typing levers associated with said letter character key members, means for supporting said typing levers for operative movement in response to actuation of each of said letter character key members, print head means associated with said letter character key members for printing letters on a print medium in response to movement of said typing levers wherein said print head means is formed to print at a printing position a selected one of a number of different letters in said given language alphabet on the print medium in response to actuation of said at least some of the letter character key members and the selected letter array format, and print head support means for supporting said print head means in operative relation to the print medium.

3. A multiple format keyboard arrangement according to claim 2, including manually actuable case selecting means for selecting one of an upper and a lower case for the letter character conveyed by said information conveying means when one of said letter character key members is actuated, and wherein said print head means is formed to print the selected letter in the selected case on the print medium.

4. A multiple format keyboard arrangement according to claim 3, including means for locking said case selecting means in a position at which the upper case is selected and for releasing said case selecting means to allow it to return to a position at which the lower case is selected.

5. A multiple format keyboard arrangement according to claim 2, wherein said information conveying means comprises carriage means including an elongated platen for supporting the print medium in proximity to said print head means.

6. A multiple format keyboard arrangement according to claim 5, wherein said print head means includes a number of elongated strike heads each fixed at one end of an associated one of said key levers, at least some of said strike heads each being formed to imprint at a striking position a selected one of at least two different letters on the print medium wherein said at least two different letters are formed successively in each of said strike heads along the direction of the long axis of the strike head, and said print head support means includes letter basket means arranged to locate the striking positions of said strike heads transversely of the long axis of said platen in response to operation of said character array format selecting means so that the selected one of the different letters formed on each of said strike heads is imprinted on the print medium supported by said platen when the corresponding letter character key member is actuated.

7. A multiple format keyboard arrangement according to claim 5, including means for rising said platen of said carriage means transversely of the long axis of said platen response to operation of said character array format selecting means, and wherein said print head means includes a number of elongated strike heads each fixed at one end of an associated one of said key levers, at least some of said strike heads each being formed to imprint at a striking position a selected one of at least two different letters on the print medium wherein said at least two different letters are formed successively in each of said strike heads along the direction of the long axis of the strike head so that the selected one of the different letters formed on each of said strike heads is imprinted on the print medium supported by said platen when the corresponding letter character key member is actuated.

8. A multiple format keyboard arrangement according to claim 1, including manually actuable case selecting means for selecting one of an upper and a lower case for the letter character conveyed by said information conveying means when one of said letter character key members is actuated.

9. A multiple format keyboard arrangement according to claim 1, including print head means arranged to print a selected one of a number of different letters in said given language alphabet on a print medium in response to actuation of one of said letter character key members and in accordance with the selected character array format.

10. A multiple format keyboard arrangement according to claim 1, wherein said character identifying means includes a number of electrically energized display elements each mounted on an associated one of said key members, and display drive means responsive to said character array format selecting means for energizing each of said display elements to display the particular character to which the key member associated with the display element corresponds.

11. A multiple format keyboard arrangement according to claim 10, wherein said display elements comprise light emitting diodes.

12. A multiple format keyboard arrangement according to claim 10, wherein said character array format selecting means includes a format select key member, and said display drive means is arranged to be operated in accordance with movement of said format select key member.

13. A multiple format keyboard arrangement according to claim 1, wherein said character array format selecting means is arranged so that said second one of said selectable character array formats is one in which the letter character key members of said middle row correspond in order from the left, as viewed by the operator, to the letters D, O, A, T, S, R, H, E, I and N.

14. The keyboard arrangement of claim 1, wherein said character array format selecting means is arranged so that said second one of said selectable character array formats is one in which the letter character key members located in the top row of said array of three rows correspond in order from the left, as viewed by the operator, to the letters Q, W, Y, F, P, B, L, U, V and Z; the letter character key members of said middle row correspond in order, from the left, to the letters D, O, A, T, S, R, H, E, I and N; and the letter character key members located in the bottom row of said array correspond in order, from the left, to the letters J, X, K, C, G and M.

15. A multiple format keyboard arrangement according to claim 1, wherein said character array format selecting means is arranged so that said second one of said selectable character array formats is one in which the letter character key members of said middle row correspond in order from the left, as viewed by the operator, to the letters L, I, O, N, S, D, R, E, A and T.

16. A multiple format keyboard arrangement according to claim 1, wherein said character identifying means comprises key caps each associated with one of said character key members and having three distinct viewable areas, a letter corresponding to said QWERTY format appearing on one of the viewable areas on each key cap and letters corresponding to the other selectable formats appearing on other viewable areas on each key cap.

17. A multiple format keyboard arrangement according to claim 16, wherein one of said viewable areas is a center surface on each key cap which surface faces generally upwardly, and said other viewable areas are slope surfaces on each key cap.

18. A multiple format keyboard arrangement according to claim 17, wherein letters corresponding to said QWERTY and the third selectable format appear on the slope surfaces of each of said key caps, and letters corresponding to the second selectable format appear on the center surface of said key caps.

* * * * *